US007743606B2

(12) United States Patent
Havlena et al.

(10) Patent No.: US 7,743,606 B2
(45) Date of Patent: Jun. 29, 2010

(54) EXHAUST CATALYST SYSTEM

(75) Inventors: Vladimir Havlena, Prague (CZ); Joseph Z. Lu, Glendale, AZ (US); Syed M. Shahed, Rancho Palos Verdes, CA (US); Michael L. Rhodes, Richfield, MN (US); Tariq Samad, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 464 days.

(21) Appl. No.: 10/992,254

(22) Filed: Nov. 18, 2004

(65) Prior Publication Data

US 2006/0101812 A1 May 18, 2006

(51) Int. Cl.
*F01N 3/00* (2006.01)

(52) U.S. Cl. ..... 60/295; 60/274; 60/286; 60/287; 60/288; 60/291; 60/292; 60/296; 60/297; 60/298; 60/324

(58) Field of Classification Search ..... 60/274, 60/286, 287, 288, 291, 292, 295, 296, 297, 60/298, 311, 324
See application file for complete search history.

(56) References Cited

U.S. PATENT DOCUMENTS

| | | | |
|---|---|---|---|
| 3,744,461 | A | 7/1973 | Davis |
| 4,005,578 | A | 2/1977 | McInerney |
| 4,055,158 | A | 10/1977 | Marsee |
| 4,252,098 | A | 2/1981 | Tomczak et al. |
| 4,383,441 | A | 5/1983 | Willis et al. |
| 4,426,982 | A | 1/1984 | Lehner et al. |
| 4,438,497 | A | 3/1984 | Willis et al. |
| 4,456,883 | A | 6/1984 | Bullis et al. |
| 4,485,794 | A | 12/1984 | Kimberley et al. |
| 4,601,270 | A | 7/1986 | Kimberley et al. |

(Continued)

FOREIGN PATENT DOCUMENTS

| | | |
|---|---|---|
| DE | 19835565 | 2/2000 |

(Continued)

OTHER PUBLICATIONS

"SCR, 400-csi Coated Catalyst," Leading NOx Control Technologies Status Summary, 1 page prior to the filing date of the present application.

(Continued)

*Primary Examiner*—Binh Q Tran
(74) *Attorney, Agent, or Firm*—Crompton Seager & Tufte LLC

(57) ABSTRACT

A catalyst system that may regenerate while removing pollutants from an exhaust gas of an engine. The system may have a converter with multiple segments of chambers. At least one of the chambers may be regenerated while the remaining chambers are removing pollutants from the exhaust. The chambers may be rotated in turn for one-at-a-time regeneration. More than one chamber may be regenerated at a time to remove collected pollutants. The system may have plumbing and valves, and possibly mechanical movement of the chambers, within the system to effect the changing of a chamber for regeneration. The chambers connected to the exhaust may be in series or parallel. A particulate matter filter may be connected to the system, and it also may be regenerated to remove collected matter.

33 Claims, 35 Drawing Sheets

U.S. PATENT DOCUMENTS 4,653,449 A 3/1987 Kamei et al.
5,044,337 A 9/1991 Williams
5,076,237 A 12/1991 Hartman et al.
5,089,236 A 2/1992 Clerc
5,108,716 A 4/1992 Nishizawa
5,123,397 A 6/1992 Richeson
5,233,829 A 8/1993 Komatsu
5,282,449 A 2/1994 Takahashi et al.
5,349,816 A 9/1994 Sanbayashi et al.
5,365,734 A 11/1994 Takeshima
5,398,502 A 3/1995 Watanabe
5,452,576 A 9/1995 Hamburg et al.
5,477,840 A 12/1995 Neumann
5,560,208 A 10/1996 Halimi et al.
5,570,574 A 11/1996 Yamashita et al.
5,598,825 A 2/1997 Neumann
5,609,139 A 3/1997 Ueda et al.
5,611,198 A 3/1997 Lane et al.
5,690,086 A 11/1997 Kawano et al.
5,692,478 A 12/1997 Nogi et al.
5,746,183 A 5/1998 Parke et al.
5,765,533 A 6/1998 Nakajima
5,771,867 A 6/1998 Amstutz et al.
5,785,030 A 7/1998 Paas
5,788,004 A 8/1998 Friedmann et al.
5,846,157 A 12/1998 Reinke et al.
5,893,092 A 4/1999 Driscoll
5,942,195 A 8/1999 Lecea et al.
5,964,199 A 10/1999 Atago et al.
5,974,788 A 11/1999 Hepburn et al.
6,029,626 A 2/2000 Bruestle
6,035,640 A 3/2000 Kolmanovsky et al.
6,048,620 A 4/2000 Zhong
6,055,810 A 5/2000 Borland et al.
6,058,700 A 5/2000 Yamashita et al.
6,067,800 A 5/2000 Kolmanovsky et al.
6,076,353 A 6/2000 Freudenberg et al.
6,105,365 A 8/2000 Deeba et al.
6,153,159 A 11/2000 Engeler et al.
6,161,528 A 12/2000 Akao et al.
6,170,259 B1 1/2001 Boegner et al.
6,171,556 B1 1/2001 Burk et al.
6,178,743 B1 1/2001 Hirota et al.
6,178,749 B1 1/2001 Kolmanovsky et al.
6,216,083 B1 4/2001 Ulyanov et al.
6,237,330 B1 5/2001 Takahashi et al.
6,242,873 B1 6/2001 Drozdz et al.
6,263,672 B1 7/2001 Roby et al.
6,273,060 B1 8/2001 Cullen
6,279,551 B1 8/2001 Iwano et al.
6,312,538 B1 11/2001 Latypov et al.
6,321,538 B2 11/2001 Hasler
6,338,245 B1 1/2002 Shimoda et al.
6,347,619 B1 2/2002 Whiting et al.
6,360,159 B1 3/2002 Miller et al.
6,360,541 B2 3/2002 Waszkiewicz et al.
6,360,732 B1 3/2002 Bailey et al.
6,379,281 B1 4/2002 Collins et al.
6,425,371 B2 7/2002 Majima
6,427,436 B1 8/2002 Allansson et al.
6,431,160 B1 8/2002 Sugiyama et al.
6,463,733 B1 10/2002 Asik et al.
6,463,734 B1 10/2002 Tamura et al.
6,470,682 B2 10/2002 Gray, Jr.
6,470,886 B1 10/2002 Cook
6,497,848 B1 * 12/2002 Deeba et al. ..... 422/180
6,502,391 B1 1/2003 Hirota et al.
6,512,974 B2 1/2003 Houston et al.
6,546,329 B2 4/2003 Bellinger
6,560,528 B1 5/2003 Gitlin et al.
6,571,191 B1 5/2003 York et al.
6,579,206 B2 6/2003 Liu et al.
6,612,293 B2 9/2003 Schweinzer et al.
6,625,978 B1 9/2003 Eriksson et al.
6,629,408 B1 10/2003 Murakami et al.
6,647,710 B2 11/2003 Nishiyama et al.
6,647,971 B2 11/2003 Vaughan et al.
6,671,603 B2 12/2003 Cari et al.
6,672,060 B1 1/2004 Buckland et al.
6,679,050 B1 1/2004 Takahashi et al.
6,687,597 B2 2/2004 Sulatisky et al.
6,705,084 B2 3/2004 Allen et al.
6,742,330 B2 6/2004 Genderen
6,758,037 B2 7/2004 Terada et al.
6,789,533 B1 9/2004 Hashimoto et al.
6,820,414 B2 * 11/2004 Stroia et al. ..... 60/286
6,823,667 B2 11/2004 Braun et al.
6,823,675 B2 11/2004 Brunell et al.
6,826,903 B2 12/2004 Yahata et al.
6,827,061 B2 12/2004 Nytomt et al.
6,989,045 B2 * 1/2006 Bailey et al. ..... 95/129
7,029,634 B2 * 4/2006 Sherwood, Jr. ..... 422/177
7,052,532 B1 * 5/2006 Liu et al. ..... 96/154
7,171,801 B2 * 2/2007 Verkiel et al. ..... 60/297
2001/0002591 A1 6/2001 Majima
2002/0029564 A1 3/2002 Roth et al.
2002/0056434 A1 5/2002 Flamig-Vetter et al.
2002/0073696 A1 6/2002 Kuenstler et al.
2002/0098975 A1 7/2002 Kimura et al.
2002/0170550 A1 11/2002 Mitsutani
2002/0173919 A1 11/2002 Moteki et al.
2002/0184879 A1 12/2002 Lewis
2002/0194835 A1 12/2002 Bromberg et al.
2003/0022752 A1 1/2003 Liu et al.
2003/0041590 A1 3/2003 Kitajima et al.
2003/0089101 A1 5/2003 Tanaka et al.
2003/0101713 A1 6/2003 Dalla Betta et al.
2003/0120410 A1 6/2003 Cari et al.
2003/0143957 A1 7/2003 Lyon
2003/0145837 A1 8/2003 Esteghlal et al.
2003/0150422 A1 8/2003 Huh
2003/0172907 A1 9/2003 Nytomt et al.
2003/0200016 A1 10/2003 Spillane et al.
2003/0213465 A1 11/2003 Fehl et al.
2003/0221679 A1 12/2003 Surnilla
2003/0225507 A1 12/2003 Tamura
2004/0006973 A1 1/2004 Makki et al.
2004/0007211 A1 1/2004 Kobayashi
2004/0007217 A1 1/2004 Poola et al.
2004/0025837 A1 2/2004 Hunt et al.
2004/0034460 A1 2/2004 Folkerts et al.
2004/0040283 A1 3/2004 Yasui et al.
2004/0040287 A1 3/2004 Beutel et al.
2004/0050037 A1 3/2004 Betta et al.
2004/0055278 A1 3/2004 Miyoshi et al.
2004/0060284 A1 4/2004 Roberts, Jr. et al.
2004/0074226 A1 4/2004 Tanaka
2004/0089279 A1 5/2004 McLaughlin et al.
2004/0112335 A1 6/2004 Makino et al.
2004/0118117 A1 6/2004 Hartman et al.
2004/0128058 A1 7/2004 Andres et al.
2004/0129259 A1 7/2004 Mitsutani
2004/0134464 A1 7/2004 Mogi
2004/0135584 A1 7/2004 Nagy et al.
2004/0139735 A1 7/2004 Zhu
2004/0139951 A1 7/2004 Fisher et al.
2004/0216448 A1 11/2004 Brillant et al.
2004/0249558 A1 12/2004 Meaney

FOREIGN PATENT DOCUMENTS

DE 10137050 2/2002
DE 10219382 11/2002
EP 1221544 7/2002

| | | |
|---|---|---|
| JP | 59190443 | 10/1984 |
| WO | 0232552 | 4/2002 |
| WO | WO 02/101208 | 12/2002 |
| WO | 03065135 | 8/2003 |
| WO | WO 2004/027230 | 4/2004 |
| WO | 03050398 | 5/2006 |

OTHER PUBLICATIONS

Advanced Petroleum-Based Fuels-Diesel Emissions Control (APBF-DEC) Project, "Quarterly Update," No. 7, 6 pages, Fall 2002.
Allanson, et al., "Optimizing the Low Temperature Performance and Regeneration Efficiency of the Continuously Regenerating Diesel Particulate Filter System," SAE Paper No. 2002-01-0428, 8 pages, Mar. 2002.
Amstuz, et al., "EGO Sensor Based Robust Output Control of EGR in Diesel Engines," IEEE TCST, vol. 3, No. 1, 12 pages, Mar. 1995.
Bemporad, et al., "Explicit Model Predictive Control," 1 page, prior to filed of present application.
Borrelli, "Constrained Optimal Control of Linear and Hybrid Systems," Lecture Notes in Control and Information Sciences, vol. 290, 2003.
Catalytica Energy Systems, "Innovative NOx Reduction Solutions for Diesel Engines," 13 pages, 3rd Quarter, 2003.
Chatterjee, et al. "Catalytic Emission Control for Heavy Duty Diesel Engines," JM, 46 pages, prior to filing date of present application.
Delphi, Delphi Diesel NOx Trap (DNT), 3 pages, Feb. 2004.
GM "Advanced Diesel Technology and Emissions," powertrain technologies—engines, 2 pages, prior to filing date of present application.
Guzzella, et al., "Control of Diesel Engines," IEEE Control Systems Magazine, pp. 53-71, Oct. 1998.
Havelena, "Componentized Architecture for Advanced Process Management," Honeywell International, 42 pages, 2004.
Hiranuma, et al., "Development of DPF System for Commercial Vehicle—Basic Characteristic and Active Regeneration Performance," SAE Paper No. 2003-01-3182, Mar. 2003.
Honeywell, "Profit Optimizer A Distributed Quadratic Program (DQP) Concepts Reference," 48 pages, prior to filing date of present application.
http://www.not2fast.wryday.com/turbo/glossary/turbo_glossary.shtml, "Not2Fast: Turbo Glossary," 22 pages, printed Oct. 1, 2004.
http://www.tai-cwv.com/sbl106.0.html, "Technical Overview-Advanced Control Solutions," 6 pages, printed Sep. 9, 2004.
Kelly, et al. "Reducing Soot Emissions from Diesel Engines Using One Atmosphere Uniform Glow Discharge Plasma," SAE Paper No. 2003-01-1183, Mar. 2003.
Kolmanovsky, et al., "Issues in Modeling and Control of Intake Flow in Variable Geometry Turbocharged Engines", 18th IFIP Conf. System Modeling and Optimization, pp. 436-445, Jul. 1997.
Kulhavy, et al. "Emerging Technologies for Enterprise Optimization in the Process Industries," Honeywell, 12 pages, Dec. 2000.
Locker, et al., "Diesel Particulate Filter Operational Characterization," Corning Incorporated, 10 pages, prior to filing date of present application.
Lu "Challenging Control Problems and Engineering Technologies in Enterprise Optimization," Honeywell Hi-Spec Solutions, 30 pages, Jun. 4-6, 2001.
Moore, "Living with Cooled-EGR Engines," Prevention Illustrated, 3 pages, Oct. 3, 2004.
National Renewable Energy Laboratory (NREL), "Diesel Emissions Control- Sulfur Effects Project (DECSE) Summary of Reports," U.S. Department of Energy, 19 pages, Feb. 2002.
Salvat, et al., "Passenger Car Serial Application of a Particulate Filter System on a Common Rail Direct Injection Engine," SAE Paper No. 2000-01-0473, 14 pages, Feb. 2000.
Shamma, et al. "Approximate Set-Valued Obeservers for Nonlinear Systems," IEEE Transactions on Automatic Control, vol. 42, No. 5, May 1997.
Soltis, "Current Status of NOx Sensor Development," Workshop on Sensor Needs and Requirements for PEM Fuel Cell Systems and Direct-Injection Engines, 9 pages, Jan. 25-26, 2000.
Stefanopoulou, et al., "Control of Variable Geometry Turbocharged Diesel Engines for Reduced Emissions," IEEE Transactions on Control Systems Technology, vol. 8, No. 4, pp. 733-745, Jul. 2000.
Storset, et al., "Air Charge Estimation for Turbocharged Diesel Engines," vol. 1 Proceedings of the American Control Conference, 8 pages, Jun. 28-30, 2000.
The MathWorks, "Model-Based Calibration Toolbox 2.1 Calibrate complex powertrain systems," 4 pages, printed prior to filing date of present application.
The MathWorks, "Model-Based Calibration Toolbox 2.1.2," 2 pages, prior to filing date of present application.
Theiss, "Advanced Reciprocating Engine System (ARES) Activities at the Oak Ridge National Lab (ORNL), Oak Ridge National Laboratory," U.S. Department of Energy, 13 pages, Apr. 14, 2004.
Zenlenka, et al., "An Active Regeneration as a Key Element for Safe Particulate Trap Use," SAE Paper No. 2001-0103199, 13 pages, Feb. 2001.

* cited by examiner

EXHAUST CATALYST SYSTEM

BACKGROUND

The present invention relates to engine exhaust systems and particularly to exhaust catalyst systems. More particularly the invention relates to catalyst units.

Spark ignition engines often use catalytic converters and oxygen sensors to help control engine emissions. A gas pedal is typically connected to a throttle that meters air into engine. That is, stepping on the pedal directly opens the throttle to allow more air into the engine. Oxygen sensors are often used to measure the oxygen level of the engine exhaust, and provide feed back to a fuel injector control to maintain the desired air/fuel ratio (AFR), typically close to a stoichiometric air-fuel ratio to achieve stoichiometric combustion. Stoichiometric combustion can allow three-way catalysts to simultaneously remove hydrocarbons, carbon monoxide, and oxides of nitrogen (NOx) in attempt to meet emission requirements for the spark ignition engines.

Compression ignition engines (e.g., diesel engines) have been steadily growing in popularity. Once reserved for the commercial vehicle markets, diesel engines are now making real headway into the car and light truck markets. Partly because of this, federal regulations were passed requiring decreased emissions in diesel engines.

Many diesel engines now employ turbochargers for increased efficiency. In such systems, and unlike most spark ignition engines, the pedal is not directly connected to a throttle that meters air into engine. Instead, a pedal position is used to control the fuel rate provided to the engine by adjusting a fuel "rack", which allows more or less fuel per fuel pump shot. The air to the engine is typically controlled by the turbocharger, often a variable nozzle turbocharger (VNT) or waste-gate turbocharger.

Traditional diesel engines can suffer from a mismatch between the air and fuel that is provided to the engine, particularly since there is often a time delay between when the operator moves the pedal, i.e., injecting more fuel, and when the turbocharger spins-up to provide the additional air required to produced the desired air-fuel ratio. To shorten this "turbo-lag", a throttle position sensor (fuel rate sensor) is often added and fed back to the turbocharger controller to increase the natural turbo acceleration, and consequently the air flow to the engine.

The pedal position is often used as an input to a static map, which is used in the fuel injector control loop. Stepping on the pedal increases the fuel flow in a manner dictated by the static map. In some cases, the diesel engine contains an air-fuel ratio (AFR) estimator, which is based on input parameters such as fuel injector flow and intake manifold air flow, to estimate when the AFR is low enough to expect smoke to appear in the exhaust, at which point the fuel flow is reduced. The airflow is often managed by the turbocharger, which provides an intake manifold pressure and an intake manifold flow rate for each driving condition.

In diesel engines, there are typically no sensors in the exhaust stream analogous to that found in spark ignition engines. Thus, control over the combustion is often performed in an "open-loop" manner, which often relies on engine maps to generate set points for the intake manifold parameters that are favorable for acceptable exhaust emissions. As such, engine air-side control is often an important part of overall engine performance and in meeting exhaust emission requirements. In many cases, control of the turbocharger and EGR systems are the primary components in controlling the emission levels of a diesel engine.

Most diesel engines do not have emissions component sensors. One reason for the lack of emissions component sensors in diesel engines is that combustion is about twice as lean as spark ignition engines. As such, the oxygen level in the exhaust is often at a level where standard emission sensors do not provide useful information. At the same time, diesel engines may burn too lean for conventional three-way catalysts.

After-treatment is often needed to help clean up diesel engine exhaust. After-treatment often includes a "flow through oxidation" catalyst. Typically, such systems do not have any controls. Hydrocarbons, carbon monoxide and most significantly those hydrocarbons that are adsorbed on particulates can sometimes be cleaned up when the conditions are right. Other after-treatment systems include particulate filters. However, these filters must often be periodically cleaned, often by injecting a slug of catalytic material with the fuel. The control of this type of after-treatment may be based on a pressure sensor or on distance traveled, often in an open loop manner.

Practical NOx reduction methods presently pose a technology challenge and particulate traps often require regeneration. As a consequence, air flow, species concentrations, and temperature should be managed in some way in order to minimize diesel emission levels.

Development of exhaust catalyst systems has been useful for meeting engine emissions requirements around the world. There has been a need for emission reduction efficiency and improved fuel economy in such developed catalyst systems.

SUMMARY

The present invention addresses a reduction of the total amount of catalyst (i.e., precious metal) needed in exhaust gas catalyst system to provide a needed NOx/SOx removal efficiency. The invention involves a multi-element catalyst that may be integrated with regeneration relative to a catalyst element configuration.

DESCRIPTION

Figure 1:
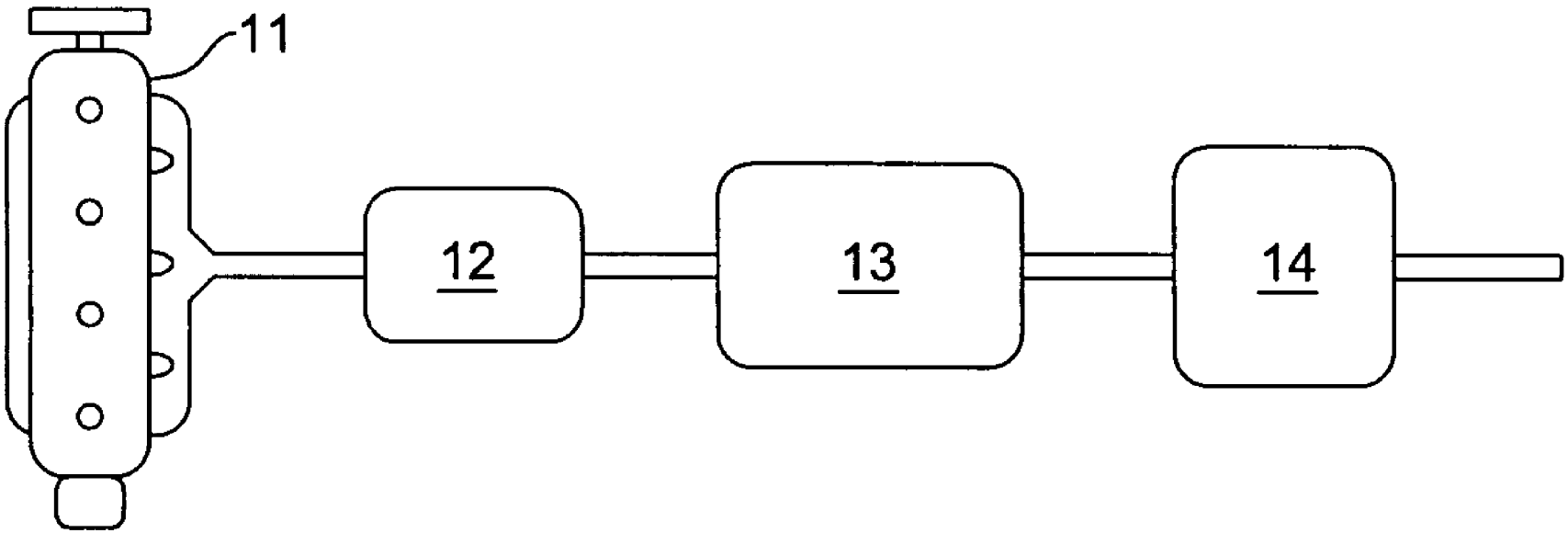
FIG. 1 shows a three member catalyst system connected an exhaust of an internal combustion engine.

In the present description, please note that much of the material may be of a hypothetical or prophetic nature even though stated in apparent matter-of-fact language. The present catalyst system may include controlled regeneration resulting in a reduction of precious metal use and of fuel consumption of the engine incorporating the system. In a monolithic catalytic NOx removal system, the effectiveness of a catalyst may be reduced along a direction of the flow of exhaust gases. To achieve a required average NOx removal (e.g., 90 percent) with a periodic pattern of catalyst usage, (e.g., a 60 second NOx adsorption mode/5 second regeneration mode), some amount of precious metal may be needed. If the total volume of the catalyst is split into "n+1" elements, with "n" elements in the exhaust gas stream used in an NOx adsorption mode and one element regenerated, and the arrangement of the elements is periodically reshufffled, the total amount of the precious metal needed may be significantly reduced. By monitoring NOx emissions, switching times and regeneration parameters may be optimized to result in reduced fuel consumption of the engine. Reference may be made to "fluid" which may be either a gas or liquid.

There may be several alternative mechanical configurations (based on switching the flow by valves or rotation of the catalyst elements), that may provide the above-noted operability. Exhaust gases may pass through "n" cleaning segments, and an "n+1" element may be regenerated. The manifold may be laid out to provide controlled flow distribution. A control system may monitor an average performance and provide control over the element configuration in the exhaust gas and regeneration streams.

In one example, NOx sensors may be provided at an inlet and outlet of an after-treatment system. These sensors may be used to determine the degree of loading of the catalyst so that a regenerated segment may be brought into the exhaust gas flow and a loaded segment be brought into the regeneration flow. In another example, only one NOx sensor might be provided, for instance at the outlet, and its reading may be used to determine when to reconfigure the multi-element catalyst. Alternatively, a combination of sensors and numerical models may be used to determine the NOx loading (adsorption site depletion) of each catalyst element.

In still another example, the state of regeneration of the element under regeneration may be monitored. Once a sufficient state is reached, then the regeneration may be halted. Since regeneration in many cases could require the burning of excess fuel, the fuel efficiency of the after-treatment may be improved.

In yet another example, the "multi-element" catalyst may be a continuously rotating device, with a speed and/or phasing of rotation matched to the effectiveness of the catalyst, and controlled through the sensing of NOx and possibly other parameters with or without supplementary use of mathematical models, such as, for example, one or more models of the regeneration process.

In the present system, the number elements may be as few as two. There is not necessarily an upper limit except as restricted by technological capabilities available at the time of application of the system.

The engines dealt with relative to the present system may be the diesel engines (or lean-burn gasoline/natural gas or alternate fuel engines). For such engines, the most significant pollutants to control may be particulate matter (PM), oxides of nitrogen (NOx), and sulfur (SOx). An example catalyst system is shown in FIG. 1. A pre-catalyst 12 may primarily be an oxidation catalyst connected to the exhaust output of an engine 11, which may for example be a 1.9 liter diesel engine. The pre-catalyst may be used to raise the temperature of the exhaust for a fast warm-up and to improve the effectiveness of the catalytic system downstream when the exhaust temperatures are too low. An underbody NOx adsorber catalyst (NAC) 13, connected to the pre-catalyst 12 may be primarily for adsorbing and storing NOx in the form of nitrates. Diesel (or lean combustion) engine exhaust tends to have excess oxygen. Therefore, NOx might not be directly reducible to N2. The NOx may be stored for a short period of time (as an example, for about a 60 second capacity). A very short period (i.e., about 2 to 5 seconds) of near stoichiometric fuel air mixture operation may be conducted to get the exhaust stream down to a near-zero oxygen concentration. The temperature may also be raised to a desirable window. Under these conditions, NOx may react with CO and HC in the exhaust to yield N2, CO2 and H2O. A base and precious metal catalyst may be used. Sensors may be situated at various places in the catalytic exhaust system and be used to detect the capacity saturation point, the need to raise the exhaust temperature, the end of the clean up, and the restoration of normal operation.

A catalytic diesel particulate filter (CDPF) 14 may be connected to the output of the NAC 13. Filter 14 may provide physical filtration of the exhaust to trap particulates. Whenever the temperature window is appropriate, then oxidation of the trapped particulate matter (PM) may take place.

In addition to the 60/2-5 second lean/rich swing for NOx adsorption/desorption reduction, there may be other "forced" events. They are desulfurization and PM burn-off. The NOx adsorption sites may get saturated with SOx. So periodically the SOx should be driven off which may require a much higher temperature than needed for NOx desorption. As to PM burn-off, there may be a "forced" burn-off if driving conditions (such as long periods of low speed or urban operation) result in excessive PM accumulation. The accumulation period may be several hours depending on the duty cycle of operation. The clean up may be several minutes (about 10). Higher temperatures and a reasonable oxygen level may be required.

It can be seen that the above-noted catalytic system may involve a complex chemical reaction process. This process may utilize a control of flows and temperatures by a computer.

Figure 2:
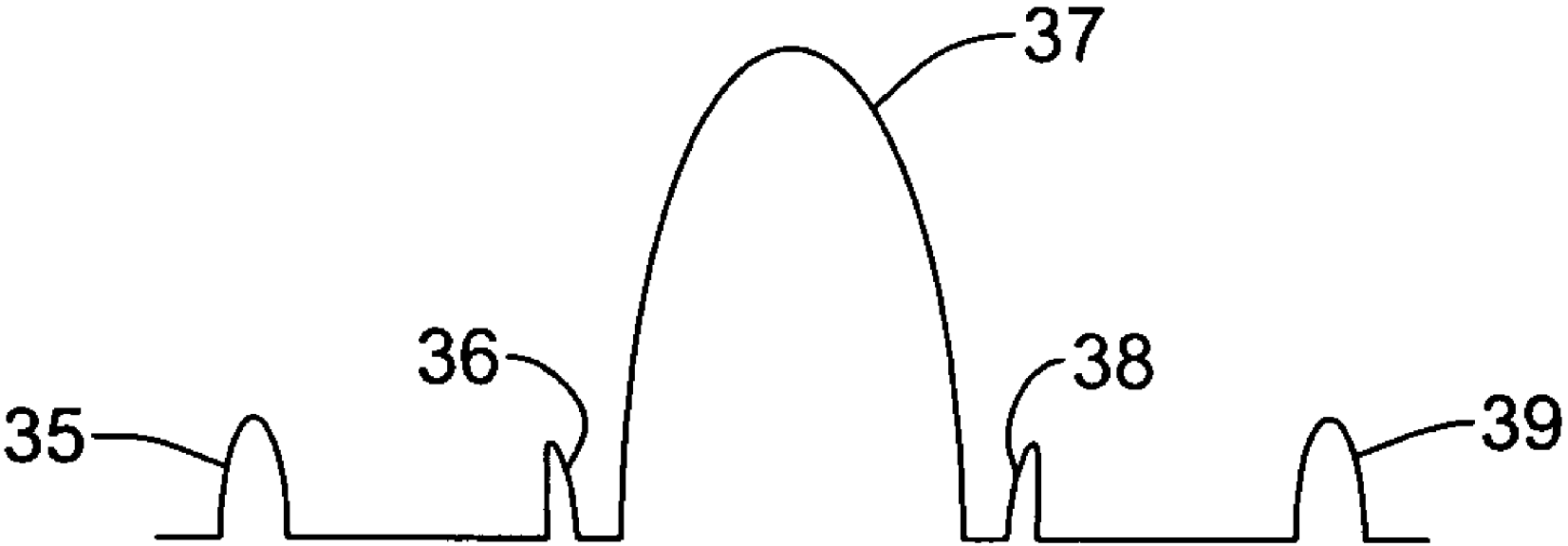
FIG. 2 is a graph of fuel injector events and the magnitudes reflecting some injection rate control for an engine.
Figure 3:
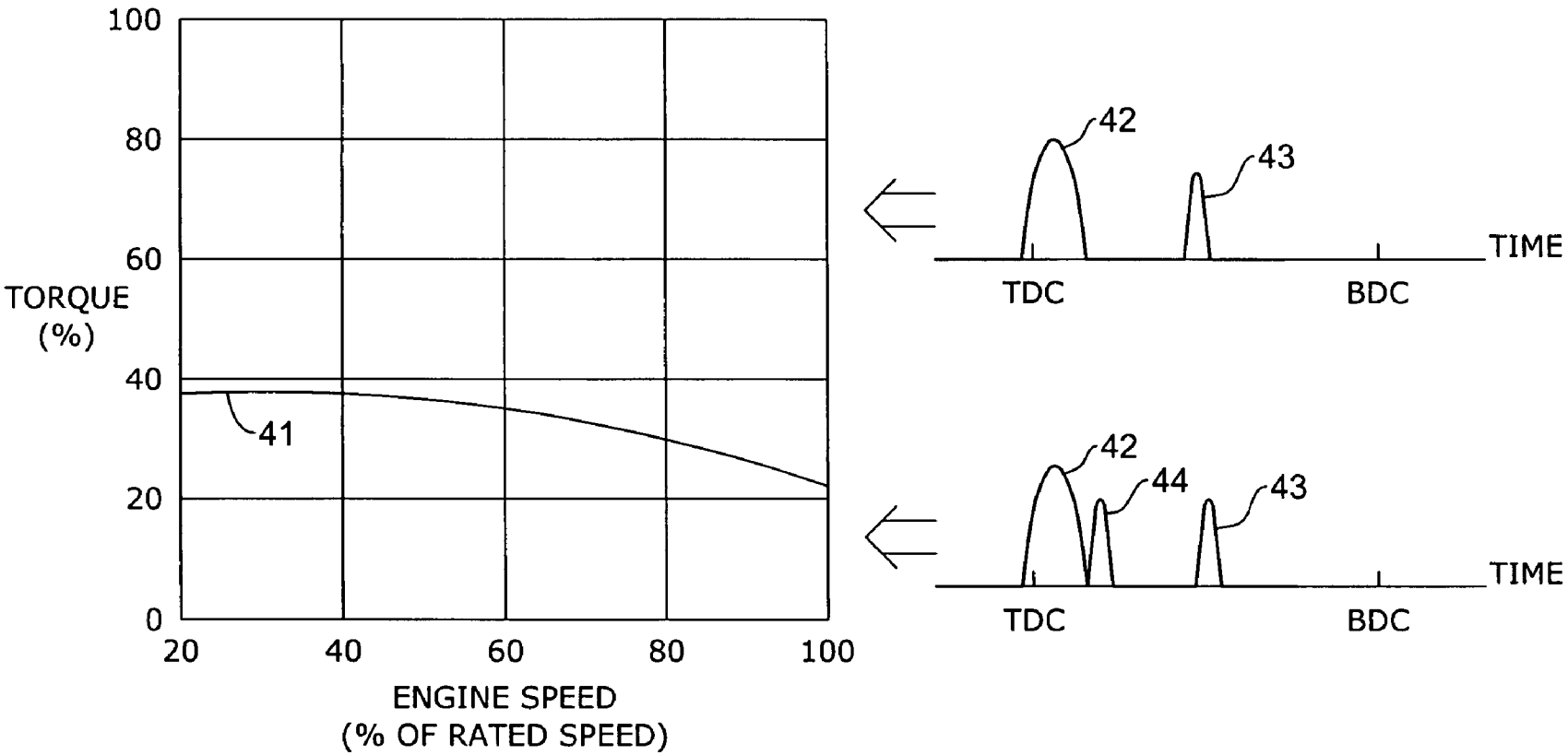
FIG. 3 is a graph combination showing engine performance relative to exhaust temperature management with several patterns of post injection events.

Fuel injection systems may be designed to provide injection events, such as the pre-event 35, pilot event 36, main event 37, after event 38 and post event 39, in that order of time, as shown in the graph of injection rate control in FIG. 2. After-injection and post-injection events 38 and 39 do not contribute to the power developed by the engine, and may be used judiciously to simply heat the exhaust and use up excess oxygen. The pre-catalyst may be a significant part of the present process because all of the combustion does not take place in the cylinder. FIG. 3 is a graph showing management of exhaust temperature. Line 41 is a graphing of percent of total torque versus percent of engine speed. The upper right time line shows a main injection event 42 near top dead center (TDC) and a post injection event 43 somewhat between TDC and bottom dead center (BDC). This time line corresponds to a normal combustion plus the post injection area above line 41 in the graph of FIG. 3. The lower right time line shows the main injection event 42 and a first post injection event 44 just right after main event 42, respectively, plus a second post injection event 43. This time line corresponds to a normal combustion plus two times the post injection area below line 41 in the graph of FIG. 3.

In some cases when the temperature during expansion is very low (as under light load conditions), the post injection fuel may go out as raw fuel and become difficult to manage using the pre-catalyst 12. Under such conditions, two post injections 44 and 43 may be used—one to raise temperatures early in the expansion stroke and the second to raise it further for use in downstream catalyst processes. There could be an impact on the fuel economy of the engine.

Figure 4:
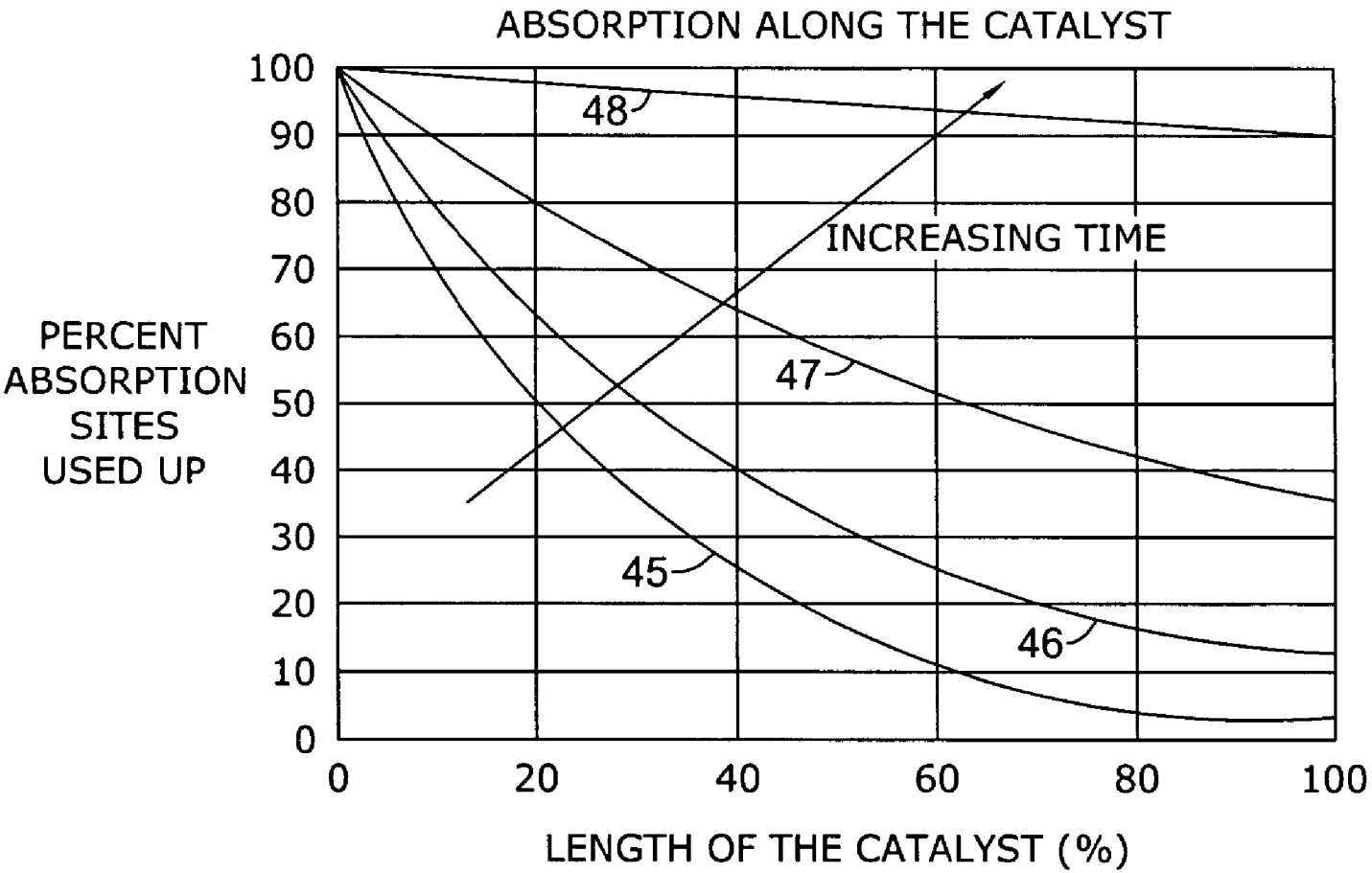
FIG. 4 is a graph illustrating an example of a rate of depletion of adsorption sites on catalyst over time.

One aspect of the present system may be based on information from process control. Normally in a catalytic flow system, the effectiveness of a catalyst may be reduced exponentially along the direction of flow as shown in FIG. 4. FIG. 4 is a graph showing an example of a deterioration rate of a catalyst. The graph shows a percent of absorptions sites depleted versus the percent of the total length of the catalyst device. Curves 45, 46, 47 and 48 are plots of sites depleted versus catalyst length for different time periods with increasing time as shown in the graph.

Figure 5:
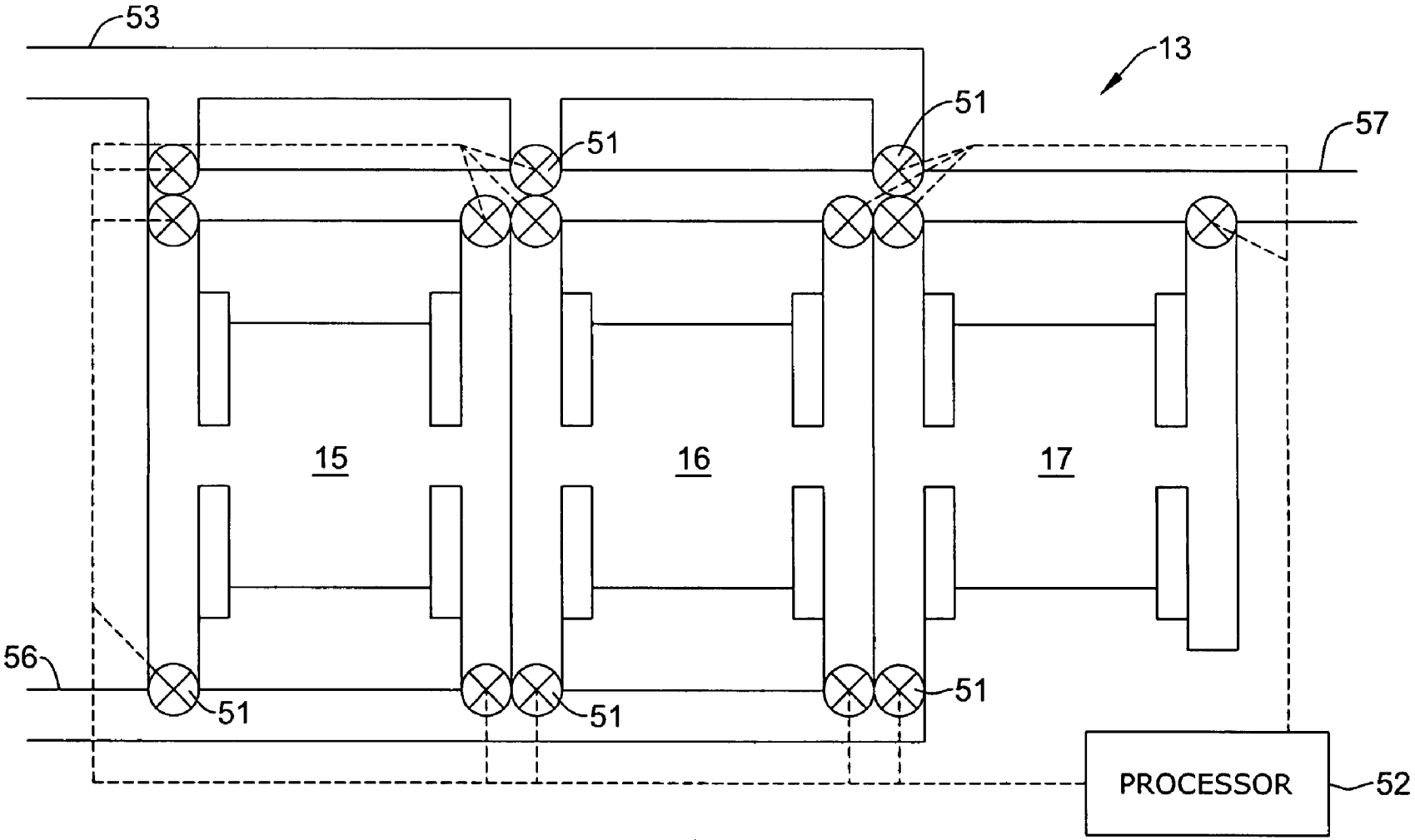
FIG. 5 shows an illustrative example of a regenerative catalyst system with valves and a connected processor.
Figure 6:
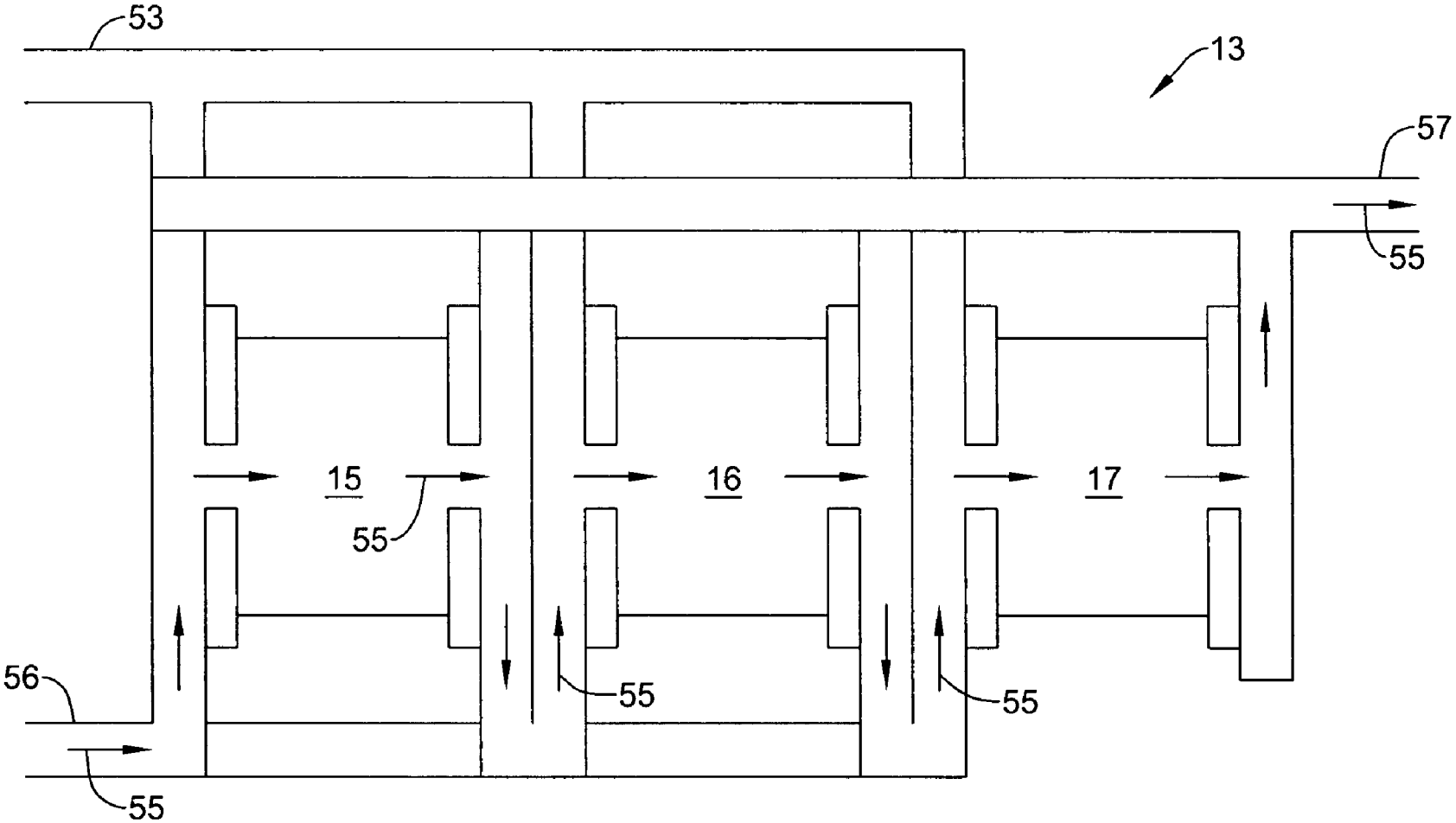
FIGS. 6-9 show the example regenerative catalyst system, with series-connected chambers, showing the various flow circuits for the regeneration of each chamber.
Figure 7:
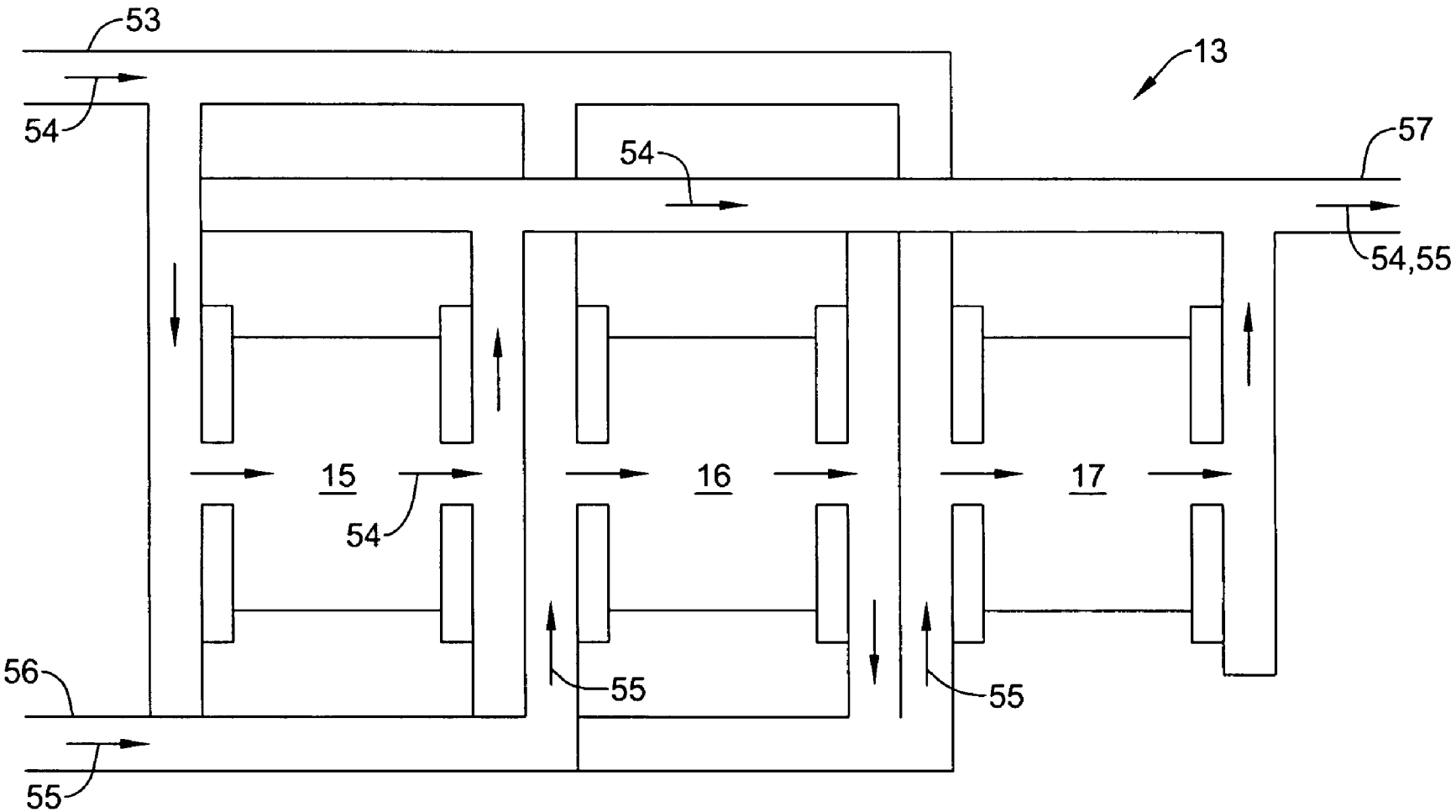
Figure 8:
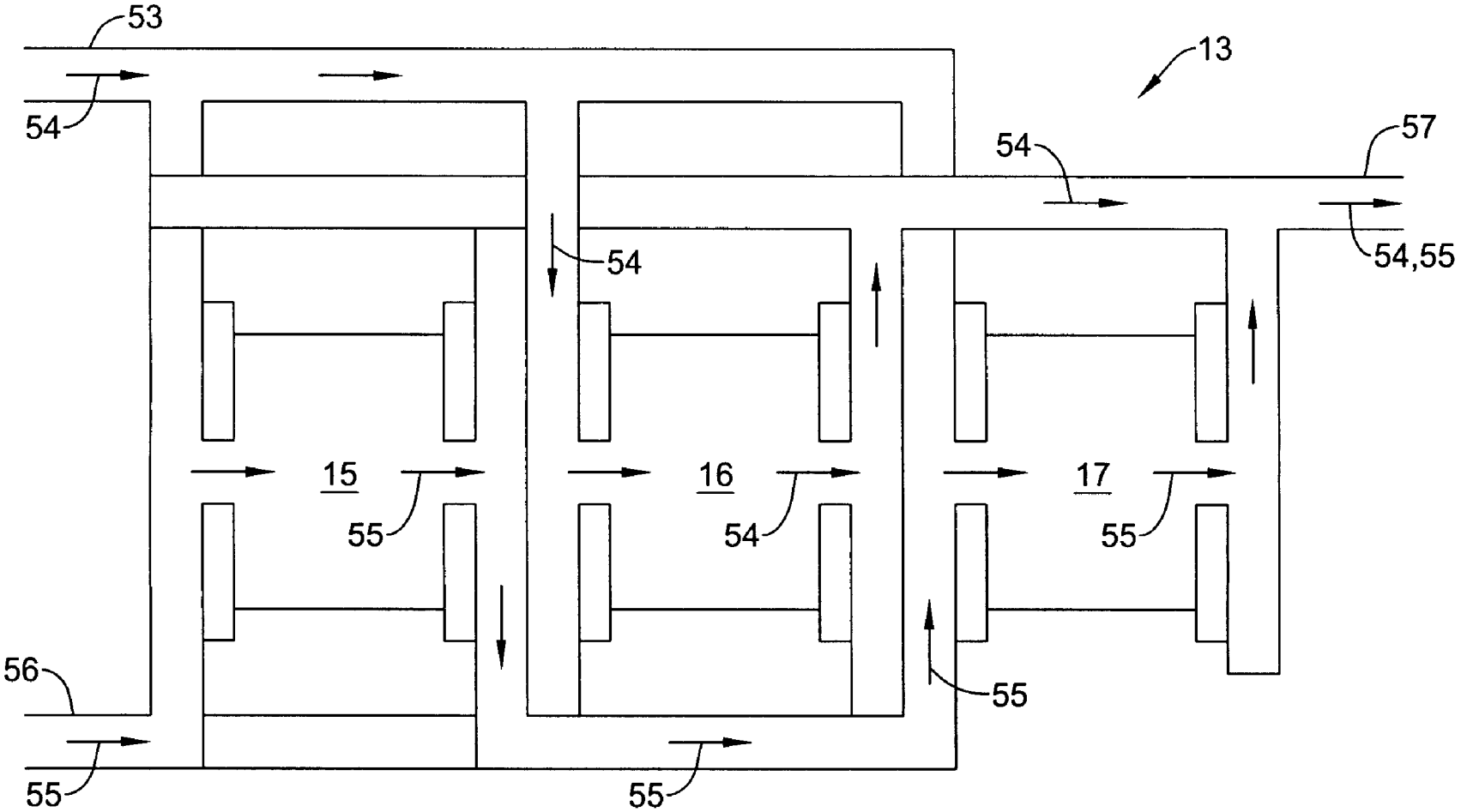
Figure 9:
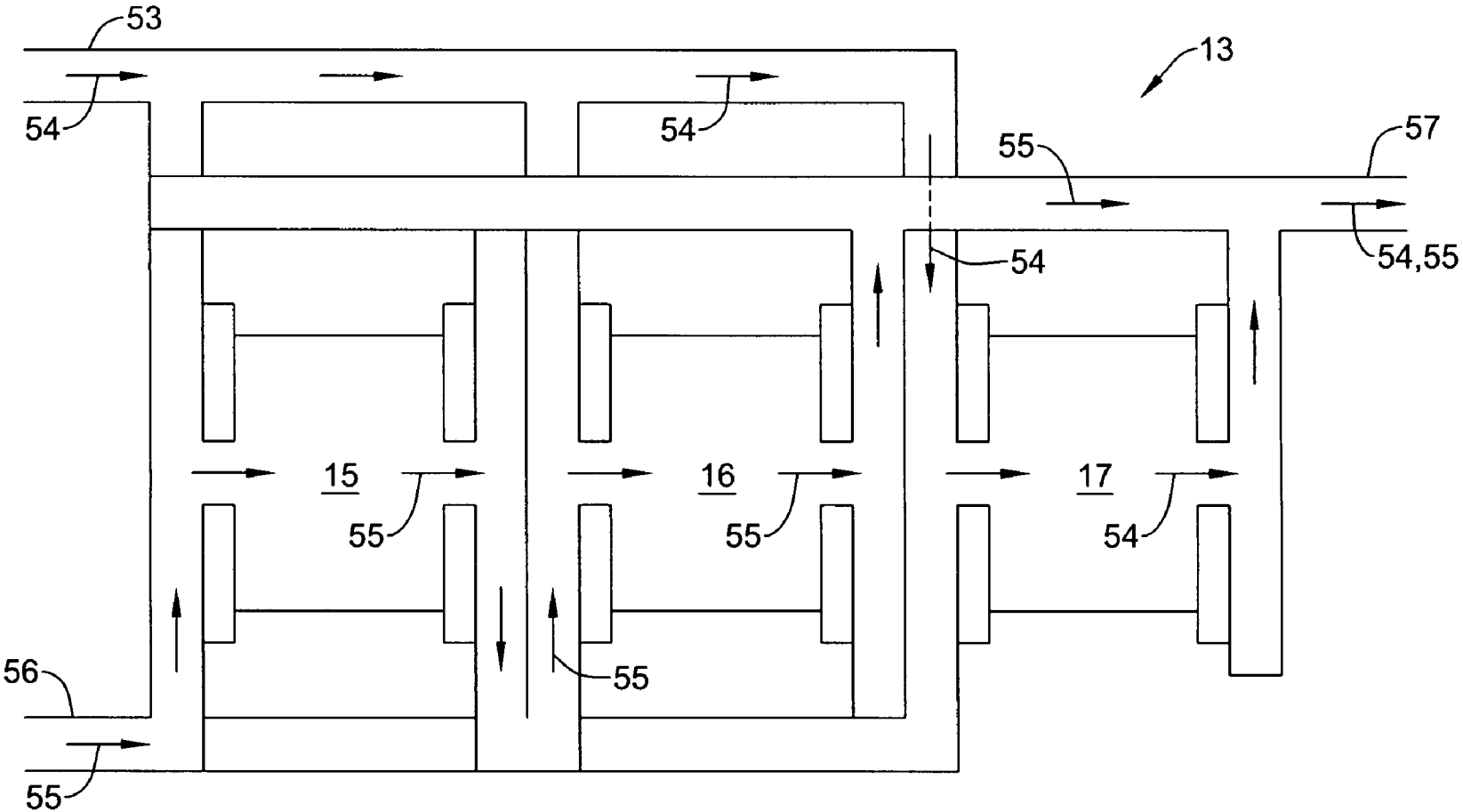

Another aspect of the present system may be a segmented or sectioned NAC 13. The NAC may be divided into "n" sections. As an illustrative example, a three section NAC with intelligent control valves 51 is shown in FIG. 5. Valves 51 with actuators may be connected (as shown by dashed lines) to a controller or processor 52 for control. FIGS. 6-9 show various configurations of operation of the three-section NAC 13. The valves 51 and processor 52, not shown in FIGS. 6-9, may be used to provide the various flow paths for the exhaust gases and regeneration fluid. Under conditions when the catalyst is fresh, the flow may go through all three sections 15, 16 and 17, in series, as shown in FIG. 6. When the first section 15 of the catalyst is depleted with adsorbed NOx, the exhaust flow 55 may be diverted to the second section 16 and third section 17, as shown in FIG. 7, without a loss of effectiveness. The first section 15 may then be regenerated by a flow 54. As shown in FIG. 8, the flow 55 may be diverted to the first section 15 and third section 17, with the second section 16 being regenerated by flow 54. FIG. 9 shows the flow 55 being run through the first and second sections 15 and 16, with the regeneration flow 54 in the third section 17.

System 13 may have sensors for detecting pressure, temperature, flow, NOx, SOx, and other parameters, situated in various locations of the system as desired and/or needed. The sensors may be connected to processor 52. Exhaust gases 55 may enter an inlet 56, go through several segments 15, 16 and or 17, and then exit outlet 57. A regeneration fluid 54 may come through an inlet 53 to be directed by valves 51 to the segment or chamber that is to be regenerated.

Figure 10A:
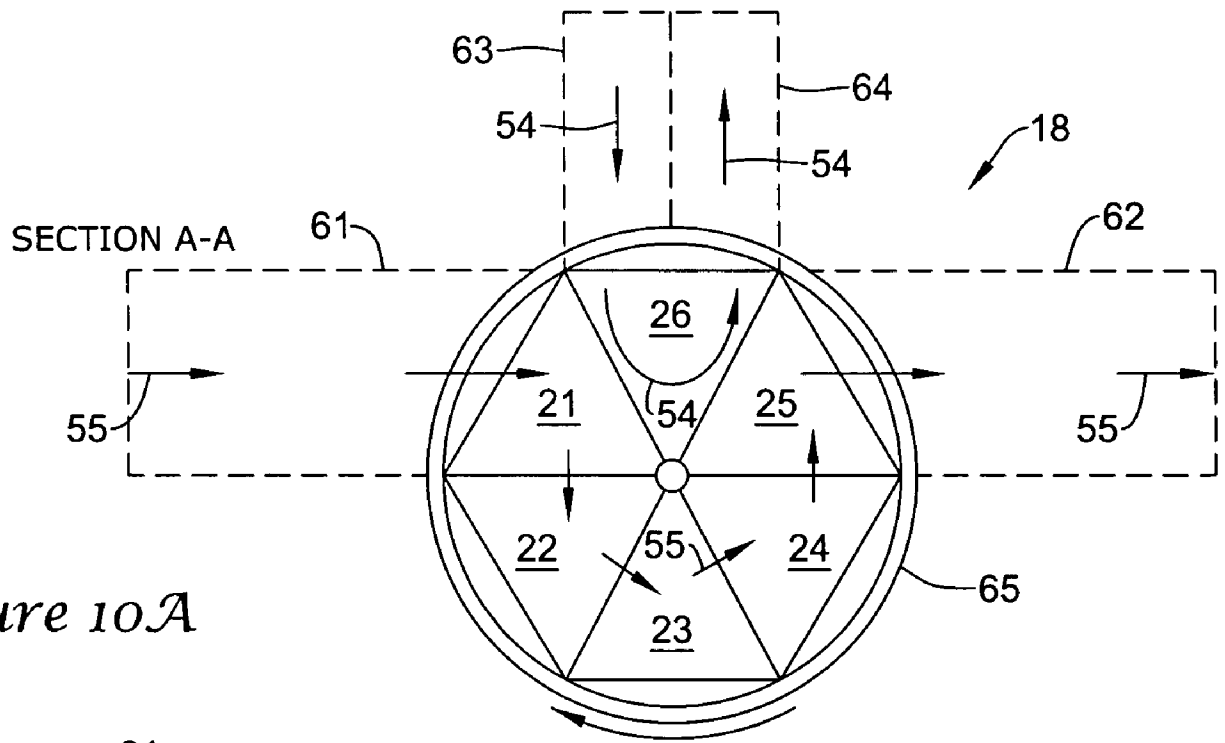
FIGS. 10*a* and 10*b* reveal a catalyst system having a rotatory structure to effect regeneration for each of the segments.
Figure 10B:
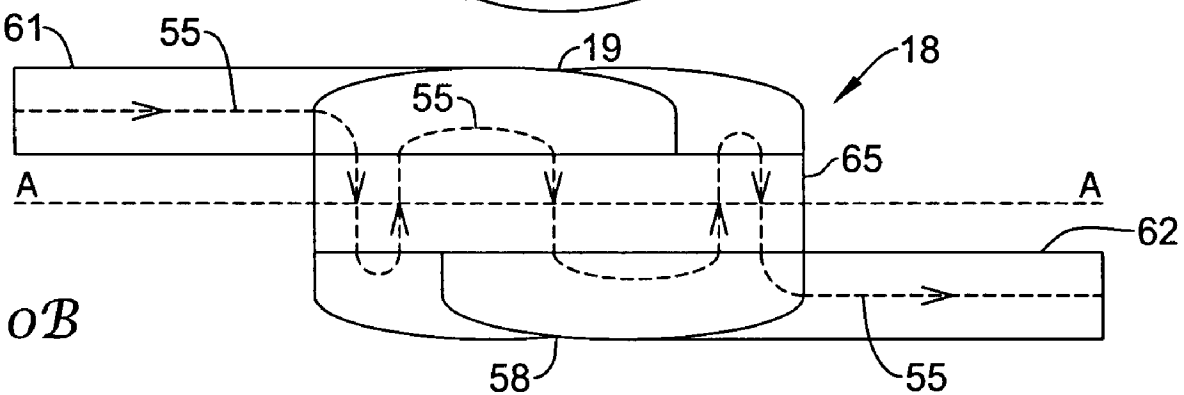

Another illustrative example, shown in FIGS. 10*a* and 10*b*, reveals a configuration 18 of the NAC 13. In configuration 18, the exhaust gases 55 may pass through five cleaning segments 21, 22, 23, 24, and 25, with a sixth segment 26 being regenerated with a flow 54. A distribution manifold 19 for the NAC may provide an input 61 and flow distribution of exhaust 55 through the segments in place for cleaning the exhaust. A collection manifold 58 may provide flow distribution, in conjunction with manifold 19, of exhaust through the cleaning segments. Manifold 58 also may provide an outlet 62 for the exhaust 55 from device 18.

Intake 63 may convey a regeneration fluid 54 through a segment 26 for cleaning out the collected pollutants from the exhaust 55. An outlet 64 may provide for an exit of the cleaning or oxidizing fluid 54 from segment 26. The catalyst segments may be rotated to switch in another segment for regeneration. For instance, after the sixth segment 26 is regenerated, then the first segment 21 may be moved in and regenerated, and the exhaust may flow through the second to sixth segments 22-26. This rotation may continue with the second segment 22 being regenerated and the exhaust flowing through the remaining segments, and so on. Structure 65 may mechanically support the rotation of the segments and be a support for manifolds 19 and 58. Also, structure 65 may include a manifold and support of the input 63 and output 64 for the regeneration with fluid 54 of the segment in place for the regeneration. An analysis for the configuration 18 of the NAC 13 is noted below.

An aspect of the present system is the NOx regeneration (i.e., removal) or cleansing. The NOx regeneration process may be one of desorption and catalytic reduction of NOx by CO and HC (unburnt hydrocarbons) under controlled temperature, controlled CO and HC concentration and near-zero free oxygen conditions. Generally, in ordinary systems, all of the exhaust may be heated and the oxygen used up for short periods of time (about 2 to 5 seconds) at frequent intervals (every 60 seconds or so). In the present system, the regeneration flow may be independent of the exhaust flow. Regeneration flow may consist of controlled 1) diverted exhaust, 2) diverted EGR flow from upstream of the turbine, 3) fresh air diverted from the intake, or 4) fresh air supplied from an independent source. A control system for catalyst flow processes may thus be linked to a control system for the air/EGR flow processes, controlled by a VNT (variable nozzle turbine)

turbocharger. Only a small portion of flow may be needed. Therefore, the amount of fuel needed to increase the temperature and use up all of the oxygen may be likewise very small. Thus, the impact on the fuel economy may be reduced significantly. Fuel may be burnt in commercially available burners (e.g., such burners for use in diesel exhaust may have been developed both for passenger car and heavy duty truck applications), or with the use of a small "pre-catalyst".

Additionally, because regeneration flow rates are small, space velocity may be low and the efficiency of NOx reduction may be high. Space velocity is a measure of gas volume flow rate/catalyst volume. Higher space velocity for a given temperature and chemistry may usually mean lower catalyst efficiency. Diverted flow may be controlled to be a very low flow rate and may result in high efficiency for NOx desorption and reduction. One other benefit may deal with PM emissions. The state of the process of after-injection may result in very high PM emissions. These emissions may be trapped in the downstream CDPF 14, but this frequent high dose of PM may represent high back pressure, more forced CDPF regenerations—both of which may impose a fuel economy penalty. Thus, there may be more fuel saving to be had with the use of a controlled regeneration process, independent of the main exhaust flow rate. Previously, parallel flow paths may have been considered. One path may be trapping/catalyzing while the other is regenerating. This approach may make the regeneration process independent of the exhaust flow rate but may double the size of the catalyst. However, the present system may reduce the size of the catalyst to a size of "1/n". There may be asymmetric flow paths.

Another aspect of the present system may be of the pre-catalyst 12. During an emissions test cycle, the first about 100 seconds of operation may be responsible for about 85 percent of the emissions, because during this time the catalyst may be too cold to be effective. The pre-catalyst may serve several functions—a fast warm-up of the catalytic system, and exhaust temperature and composition control by oxidizing unburnt fuel of secondary or post injections. The parallel regeneration flow stream described in a noted aspect of the present system may also be used for fast warm-up. The exhaust may be controlled to flow through one section of the NAC 13 during startup, while the other two sections are being heated to a desired temperature using very low flow rates resulting in a low fuel penalty. The pre-catalyst 12 may be eliminated. If instead of a burner, a catalytic device is used in the regeneration stream, then the size of the catalyst may be greatly reduced because of the low flow rates.

Still another aspect of the present system may involve SOx regeneration. Sulfur is present in diesel fuel. Oxides of sulfur may occupy the sites that the NOx would have occupied. Therefore, over a period of time, SOx poisoning may render the NAC 13 ineffective. SOx may be driven off by temperatures higher than those needed for NOx regeneration. With control of the regeneration temperature, independently of the exhaust temperature of the main flow rate, it may be possible to re-optimize the SOx/NOx regeneration process to occur in overlapping temperature windows.

Figure 11:
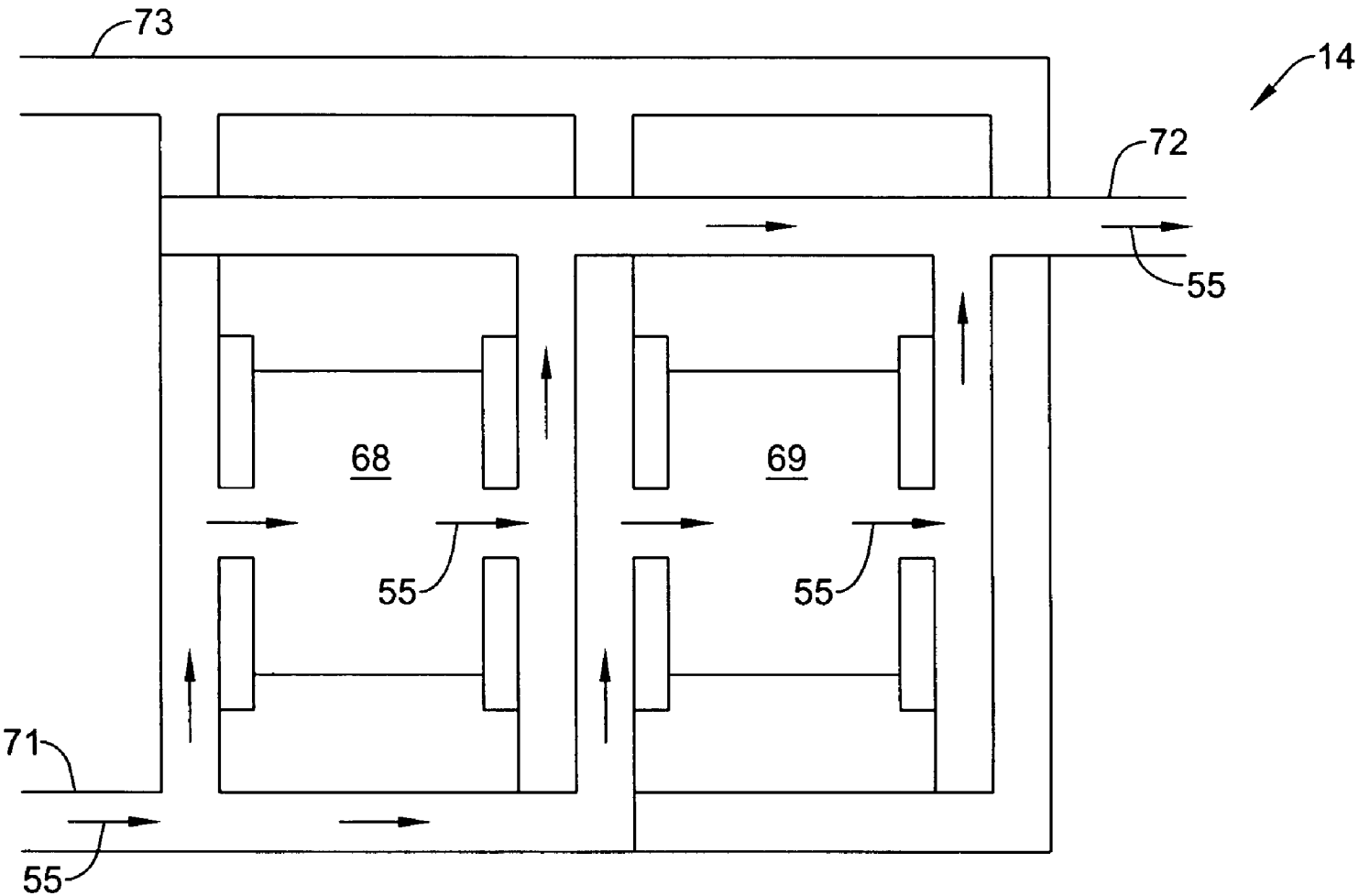
FIG. 11 shows a multi-segment catalyst system having parallel-connected chambers.
Figure 12:
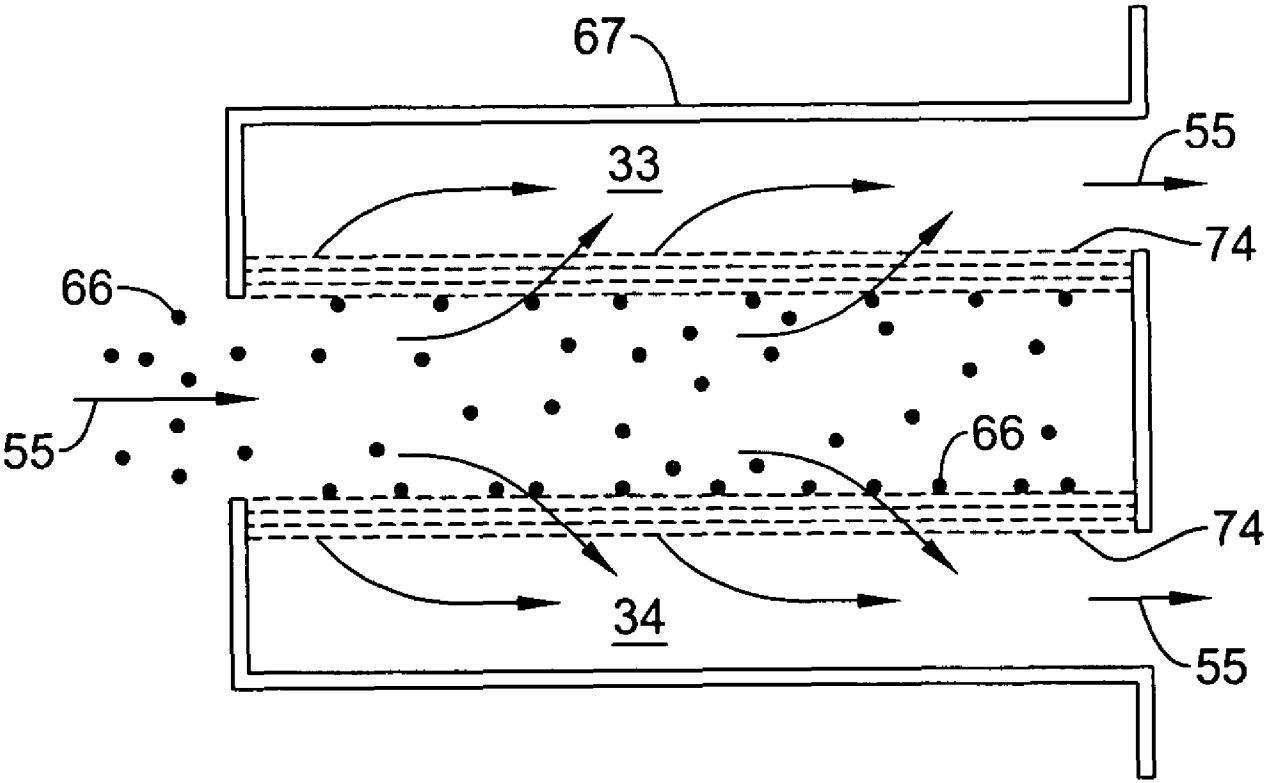
FIG. 12 reveals a particulate matter filter.

Another aspect of the present system may involve CDPF regeneration. A particulate filter 67 at the tail end of the catalytic process may be a device to physically filter, trap and oxidize PM 66. It may continuously trap and oxidize—depending on the duty cycle/temperatures. Under prolonged light load driving conditions, the CDPF 14 may continuously accumulate trapped PM 66 without regeneration. This may impose a high back pressure and fuel economy penalty on the engine. "Forced regeneration" may have to be used imposing its own fuel penalty. In the present system, the CDPF 14 may be designed with segments, sections or chambers 68 and 69 like those of NAC 13 in FIGS. 5-9. However, in the CDPF 14, the sections 68 and 69 may be in parallel flow with an input 71 and an output 72 for exhaust gases 55, as shown in FIG. 11. This sort of flow may be necessary because, unlike the NAC 13, the CDPF 14 may have a "wall flow" device configuration 67 as shown in FIG. 12. With the latter approach, alternate flow channels may be blocked with a filter device 12. Gas 55 with PM 66 may enter device 67. Gas 55 may flow through a porous filter element 74 which catches the particulate matter particles 66. The gas 55 may exit filter 67 free of particles 66. The effective flow path is not necessarily along a catalytic channel but may be more so through the porous wall 74. Thus, a series flow configuration from section to section, such as in the present NAC 13, may result in a greatly reduced effective flow area and a very high pressure drop with a filter 67 in the only throughput path. Hence, the present CDPF may incorporate a parallel flow configuration of sections 69 and 69 in FIG. 11. FIG. 12 shows the PM filter 67 having wall-flow/filtering with the filtered exhaust exiting filter channels 33 and 34.

Figure 13:
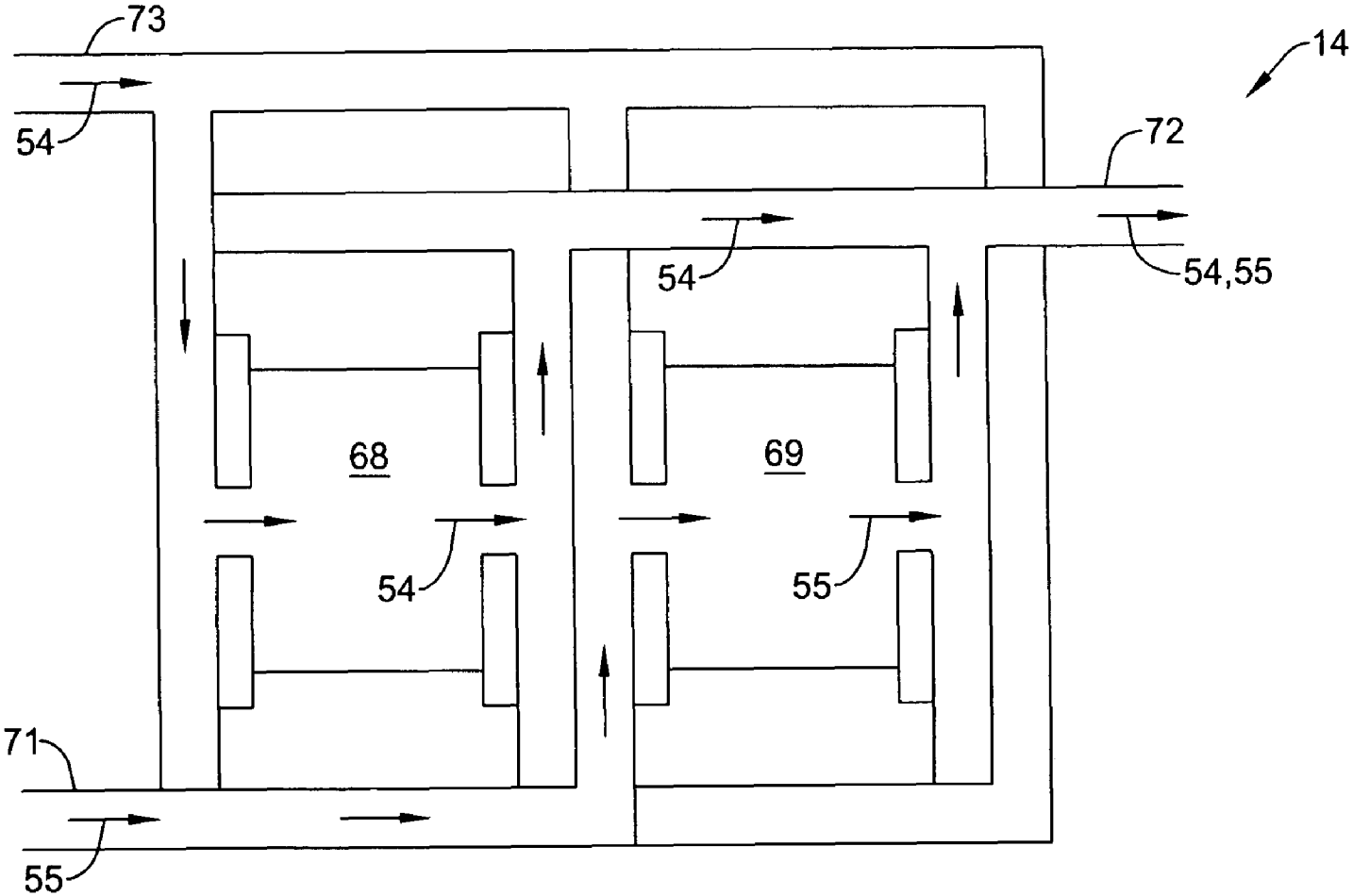
FIG. 13 shows the multi-segment catalyst system having parallel chambers but with the flow diverted for regeneration of a chamber.

Under normal conditions, within a range of CDPF 14 self-cleaning temperatures, flow conditions may be like those of the CDPF as in FIG. 11. However, under prolonged low temperature and low flow conditions, the exhaust may be diverted to only one of the sections 68 and 60, as shown in FIG. 13, via valves 51 and processor 52, as shown in FIG. 5. Gas 55 may enter inlet 71 and be diverted to chamber or segment 69 for cleaning. The gas 55 may exit system 14 via outlet 72. Chamber 68 may be blocked from receiving any gases 55 by valves 51 (not shown). However, another valve 51 may let in a regenerating fluid 54 through input 73 and on to chamber 68 for its regeneration. Fluid 54 may exit chamber 68 and leave system 14 via outlet 72. This approach should not result in an excessive pressure drop because the flow rates are low and the system 14 may handle a full load rate (i.e., a high rate). However, this configuration might not necessarily reduce the overall size of the trap/catalyst required.

FIG. 13 shows the CDPF 14 flow diversion during low flow/low temperature conditions. During such time, high temperature gases may be already available from the NOx process. This high temperature stream may be in a range in which the CDPF 14 may effectively oxidize trapped PM. However, the oxygen concentration may be low. One of two approaches may be used. One may be a controlled combination of a high temperature stream with a high oxygen concentration, low temperature exhaust stream to achieve an oxidation of trapped PM. The other may be a preheating of a section with the high temperature stream and then exposing the section to a high oxygen concentration of the low temperature stream at a controlled flow rate so as to sustain oxidation of the PM. Filter 67 may have one or more sensors situated in or about the filter. The filter sensors may be connected to a controller. The controller may determine and initiate regeneration of the filter based on inputs from the filter sensors and possibly also on one or more mathematical models, such as for example, a model of a filter regeneration process.

Applications of the present system may be with heavy duty diesel engines since they seem to be more sensitive to fuel economy than other kinds of engines. With ratios of catalyst/trap volumes to engine displacements being about 3 to 1, a 12 liter on-highway diesel engine may need 36 liters of catalyst. Other applications may include light trucks and passenger vehicles. The control box may communicate with the fuel controller on a similar level.

A model of a six-segmented catalyst, e.g., configuration 18 of the NAC 13 mentioned above and shown in FIGS. 10*a* and 10*b*, may be evaluated relative to a precious metal demand and control strategies. The model may be based on the following assumptions. In each segment, a number of adsorption sites may be evaluated as n(i,t), where i=1, . . . , 5 is the number of the segment and t(s) is time. The number of adsorption sites may be normalized, i.e., n=1 corresponds to a fresh catalyst (fully regenerated) catalyst. The concentration of NOx may be evaluated as c(i,t), where i=0, . . . , 5. i=0 corresponds to the catalyst input, i=1, . . . , 5 corresponds to the output of individual segments and t(s) is time. The concentration of NOx may be normalized, i.e., c=1 corresponds to the maximum expected concentration. The performance of the catalyst may be specified in terms of fresh catalyst performance defined by output NOx [c(5,t)<0.25 in the following example] and of catalyst performance degradation that triggers the regeneration [output NOx exceeds the threshold c(5,t)=0.1 in the following example] and degradation period at maximum load [td=60 seconds in the following example]. The results cover a basic analysis of the single-element catalyst and the multi-element catalyst.

Figure 14B:
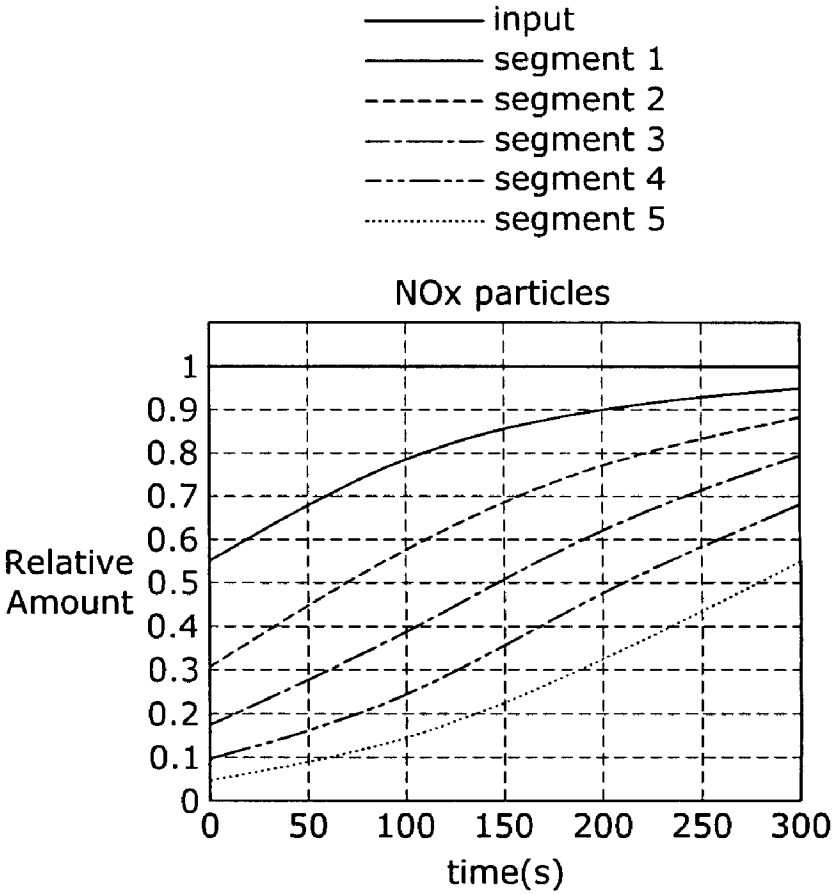
FIGS. 14*b*, 15*b* and 16*b* show the relative amount of NOx versus time at the output of each segment of a multi-segment catalyst system for various loads.
Figure 14A:
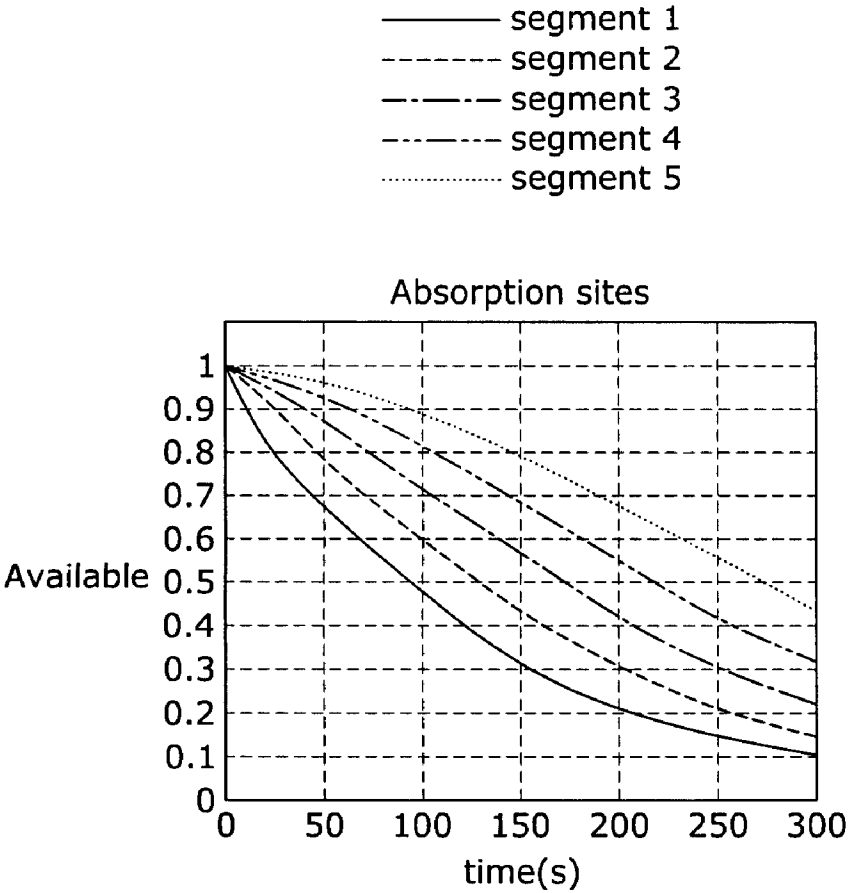
FIGS. 14*a*, 15*a* and 16*a* show the availability of adsorption sites for each segment of a multi-segment catalyst system over time for various loads.
Figure 15B:
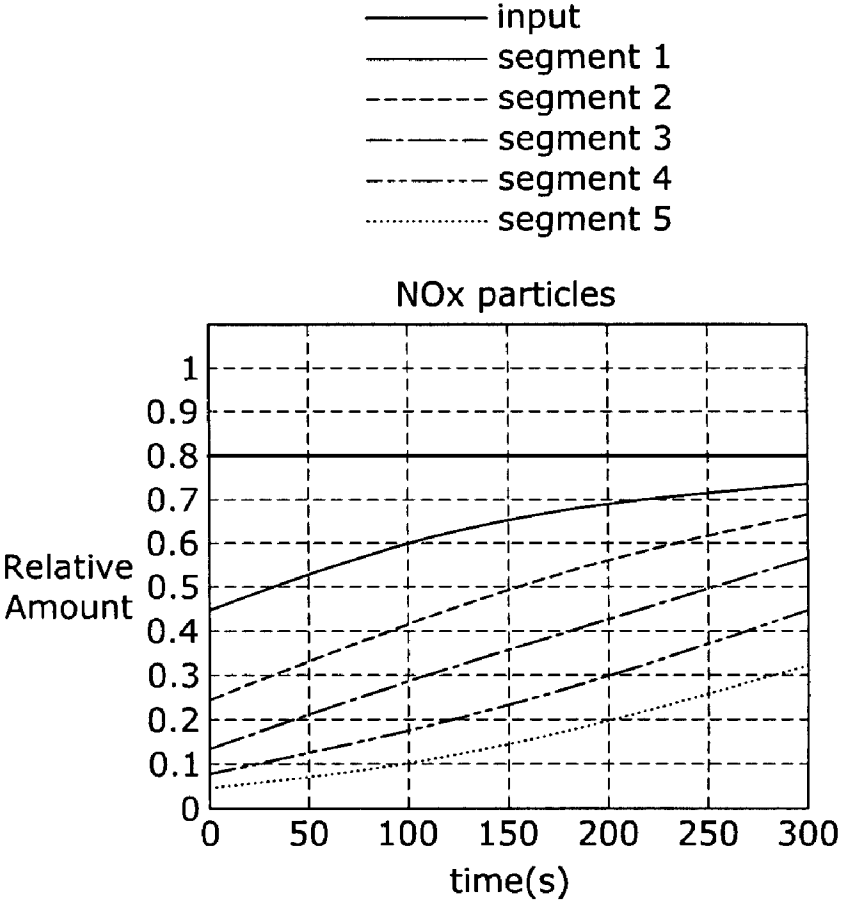
Figure 15A:
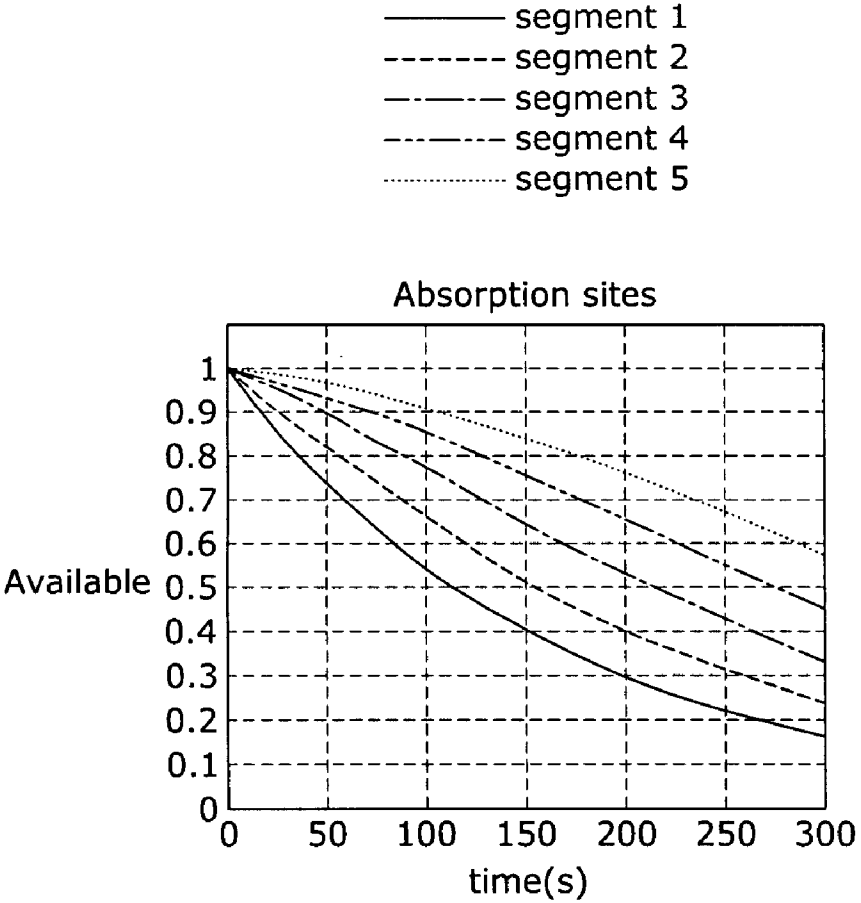
Figure 16B:
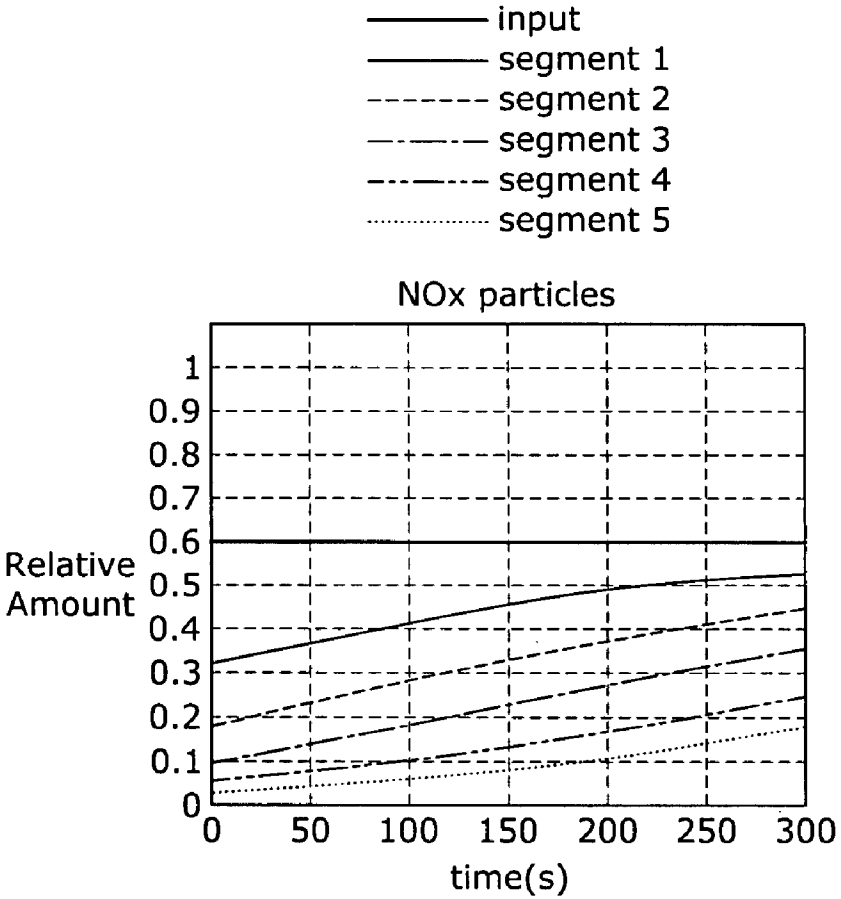
Figure 16A:
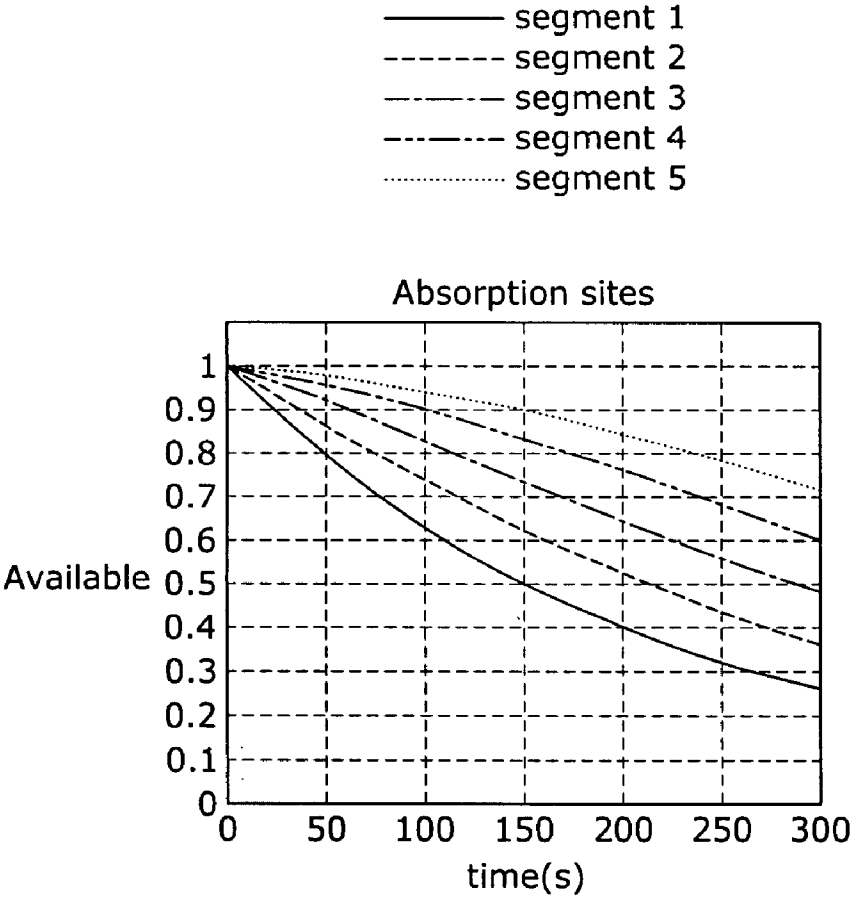

FIGS. 14*a* and 14*b* are graphs of performance of a single segment catalyst system for a maximum load performance of c_input=1. FIG. 14*a* shows the availability of adsorption sites for each of the five segments over time. FIG. 14*b* shows the relative amount of NOx particles versus time for each of the five segments. One may note the catalyst tuning relative to the initial performance c_out=0.05 and the performance deterioration c_out=0.1 at time t=60 seconds. FIGS. 15*a* and 15*b* are graphs for the same parameter of the system but for a reduced load performance of c input=0.8. Likewise, FIGS. 16*a* and 16*b* are graphs of the parameters for a system with a reduced load performance of c input=0.6.

Figure 17:
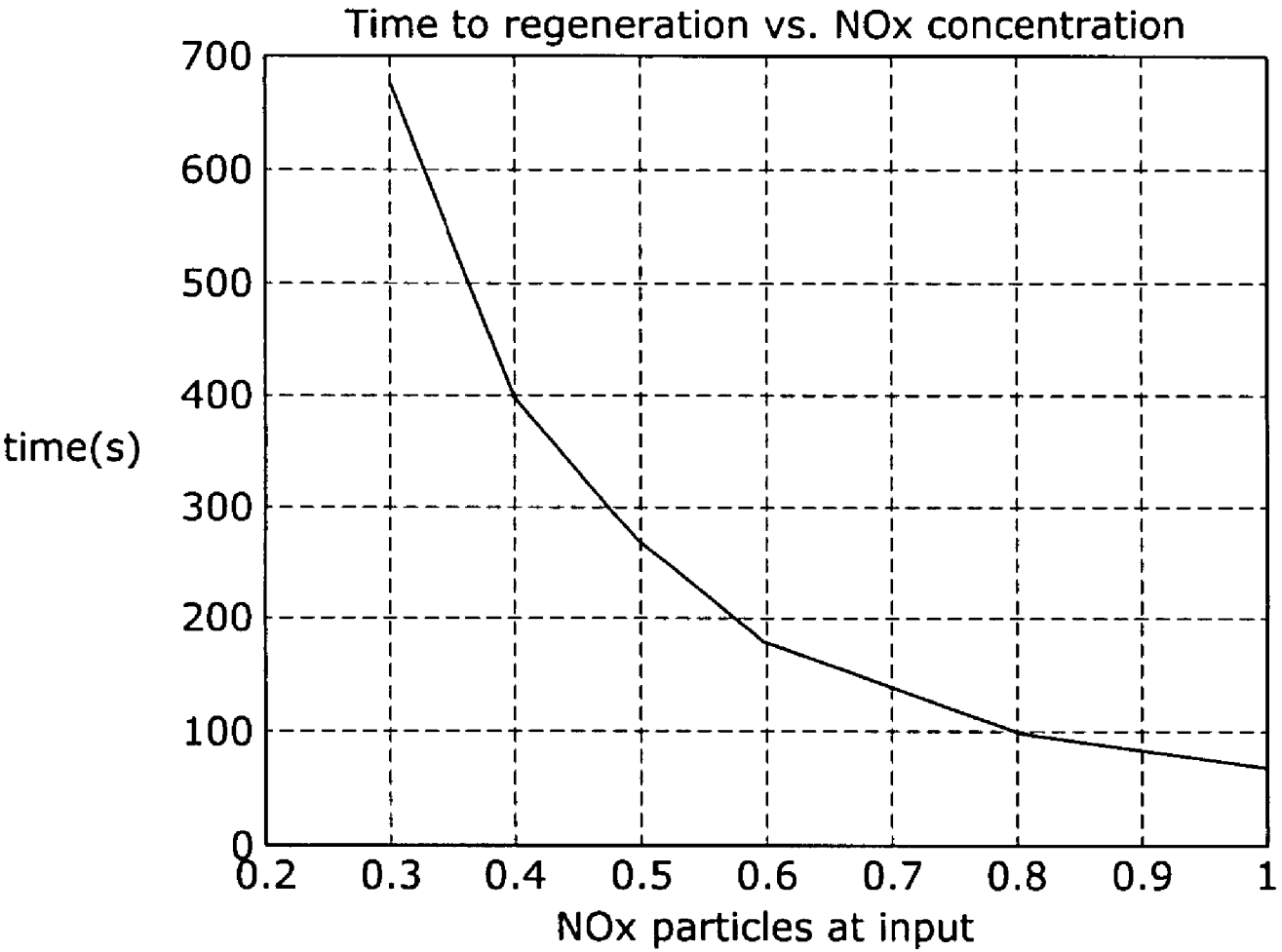
FIG. 17 is a graph showing filter time to regeneration as a function of the load for a catalyst system.

FIG. 17 is a graph showing filter time to regeneration as a function of the catalyst load (c input). That is, the time of the filter's life prior to needed regeneration is a nonlinear relationship relative to the amount of NOx at the input.

Figure 18B:
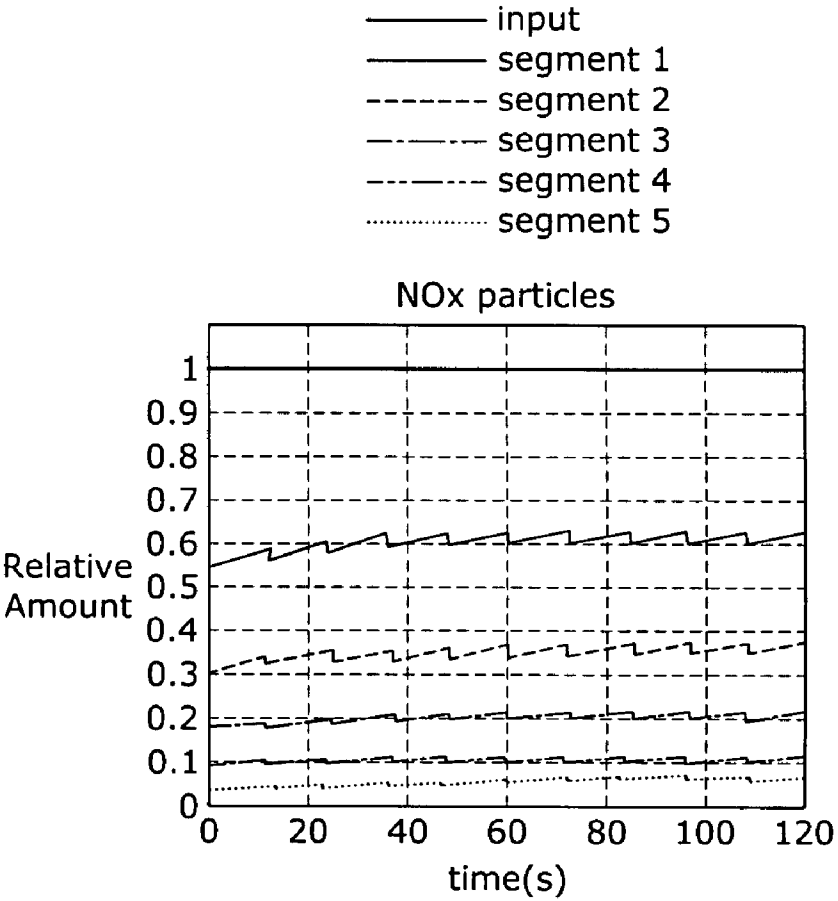
FIGS. 18*b*, 19*b*, 20*b*, 21*b* and 22*b* are graphs showing the relative amount of NOx particles coming out of each of the segment stages of a multi-segment system relative to an input of particles over time for certain regeneration periods, NOx inputs and amounts of metal of a catalyst system.
Figure 18A:
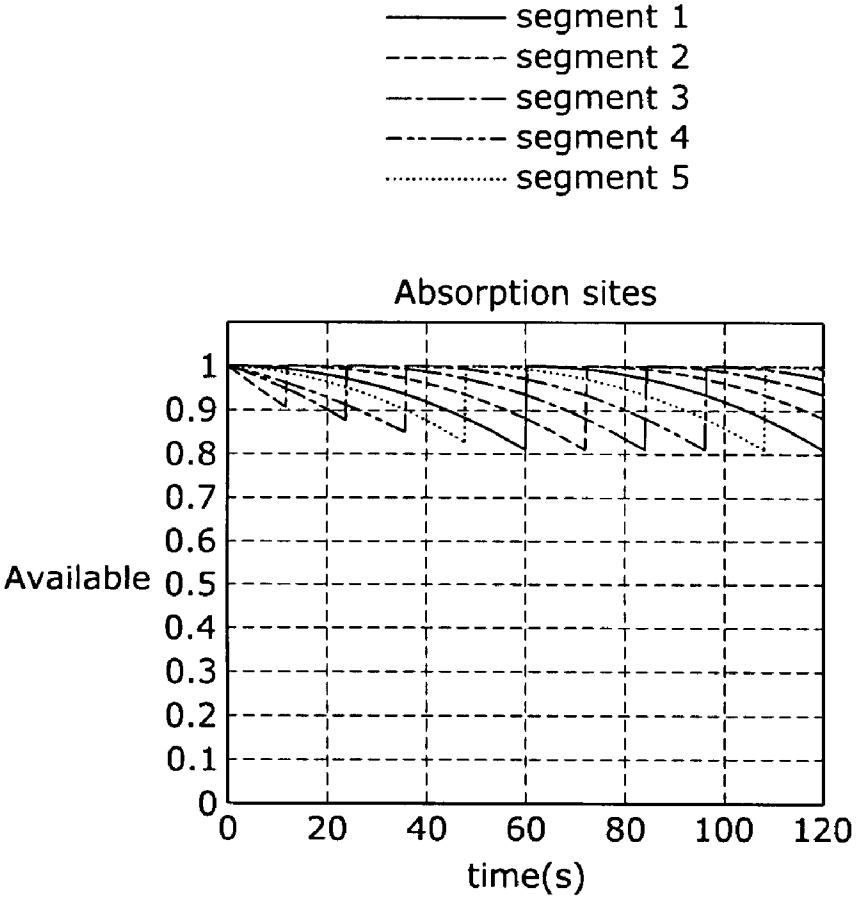
FIGS. 18*a*, 19*a*, 20*a*, 21*a* and 22*a* are graphs showing the number of adsorption sites available for each of segments of a multi-segment system for certain regeneration periods, NOx inputs and amounts of metal of a catalyst system.

The performance of a multi-segment rotating catalyst is shown in FIGS. 18*a*, 18*b*, 19*a*, 19*b*, 20*a*, 20*b*, 21*a*, 21*b*, 22*a* and 22*b*. FIG. 18*a* is a graph showing the number of adsorption sites available for each of segments 1-5 versus time for a six segment filter having a regeneration period of 60/5=12 seconds. FIG. 18*b* is a graph shows the relative amount of NOx particles coming out of each of the segment stages relative to an input of NOx over time along with the 12 second regeneration times for the segments of the six segment filter. One may note that with an equivalent filter area, the regeneration threshold c out=0.01 appears never to be reached.

Figure 19B:
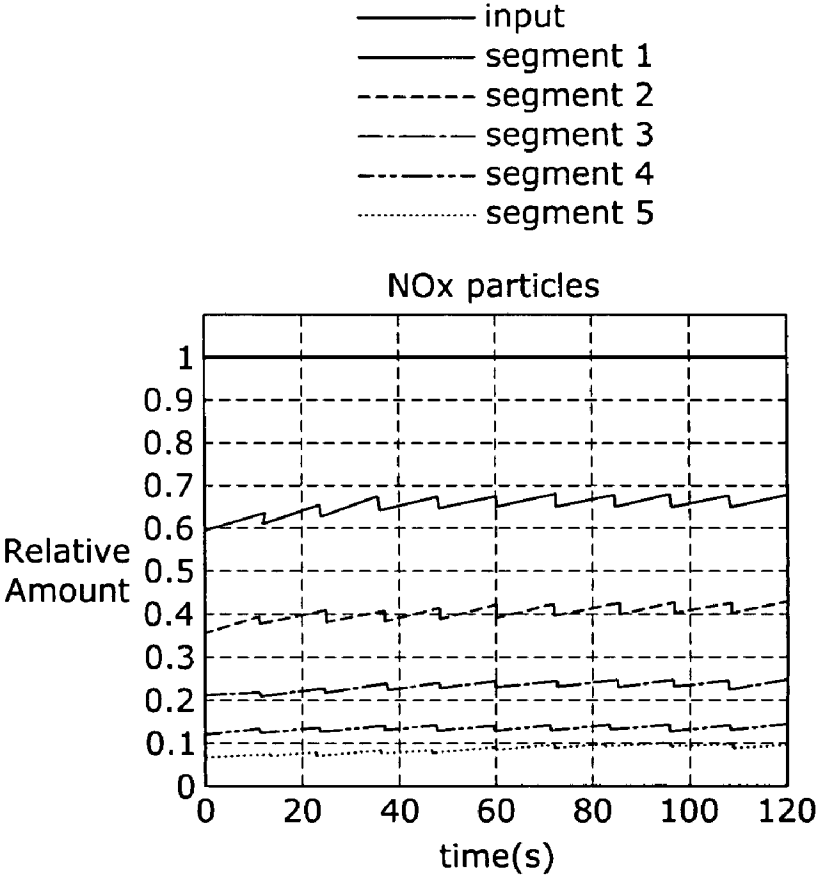
Figure 19A:
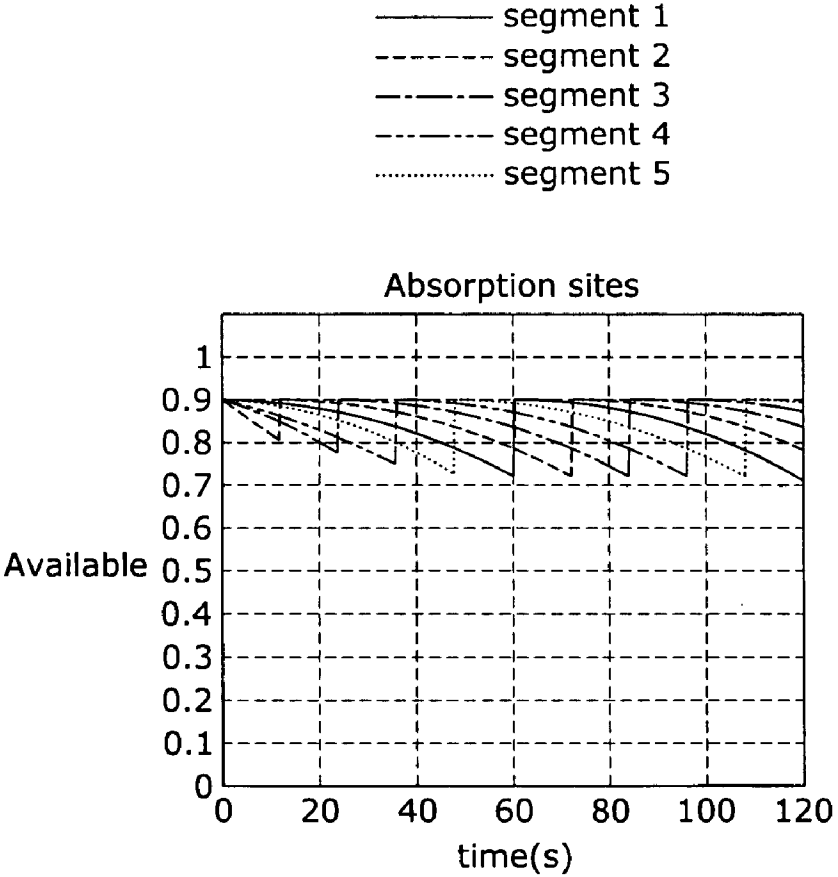

For the six-segment filter as noted above, the filter area of the catalyst is reduced to 0.9 and performance checked as shown by FIGS. 19*a* and 19*b*. FIG. 19*a* is a graph that shows the number of adsorption sites available for each of segments 15 versus time. FIG. 19*b* is a graph that shows the relative amount of NOx coming out of each of the segment stages relative to an input over time.

Figure 20B:
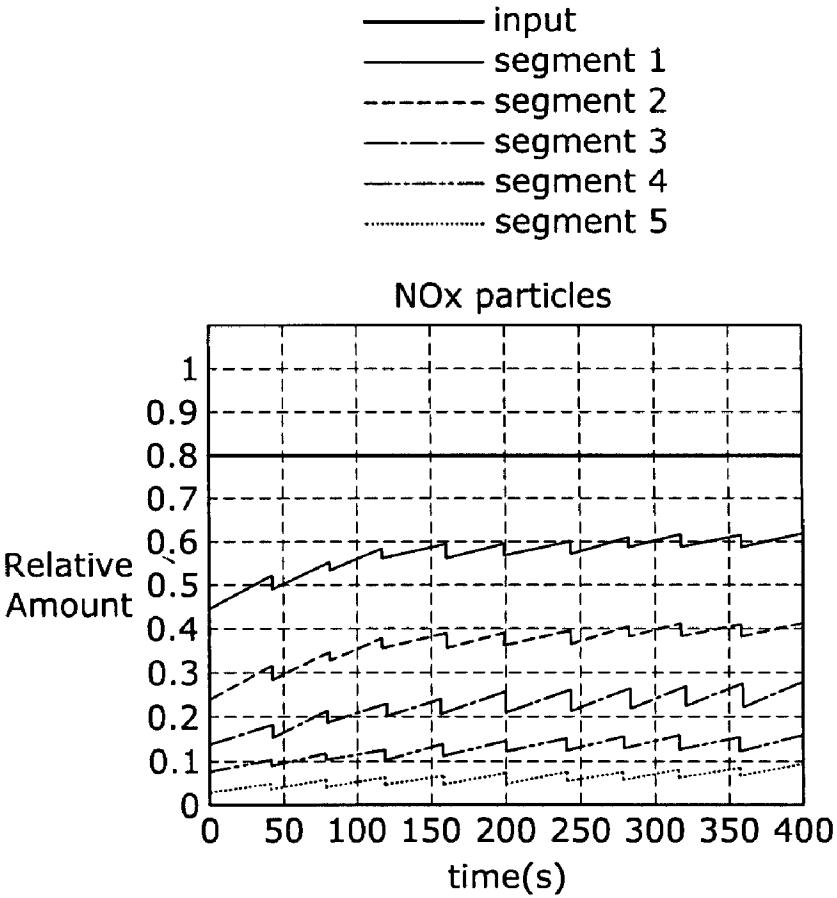
Figure 20A:
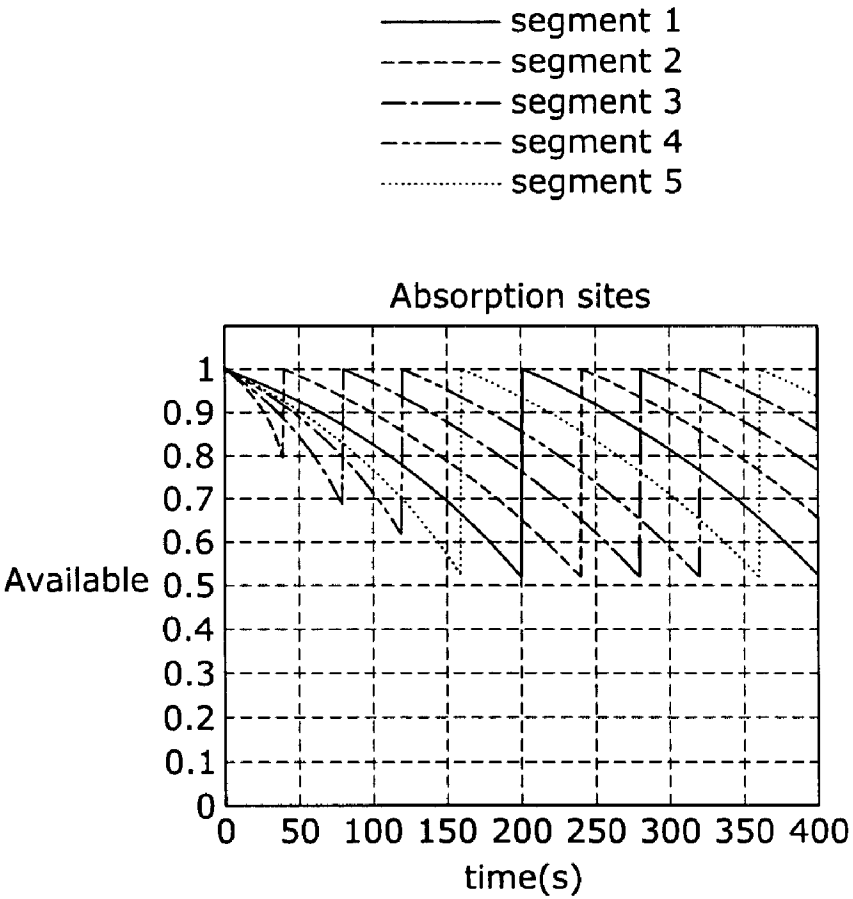

FIGS. 20*a* and 20*b* are graphs showing the impact of a reduced NOx input of 0.8 into the catalyst system with a reduced regeneration rate. The time axis is to 400 seconds versus 120 second in the immediate previous four graphs. FIG. 20*a* shows the number of adsorption sites available for each of segments 15 versus time. FIG. 20*b* shows the relative amount of NOx coming out of each of the segment stages relative to an input of particles over time.

Figure 21B:
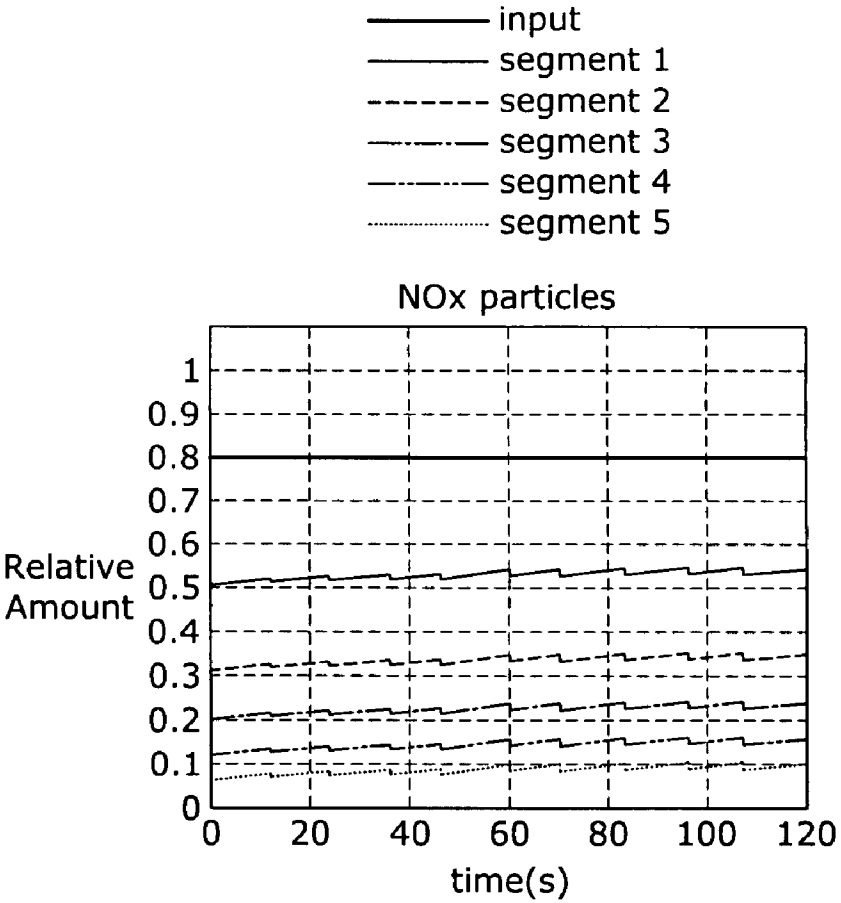
Figure 21A:
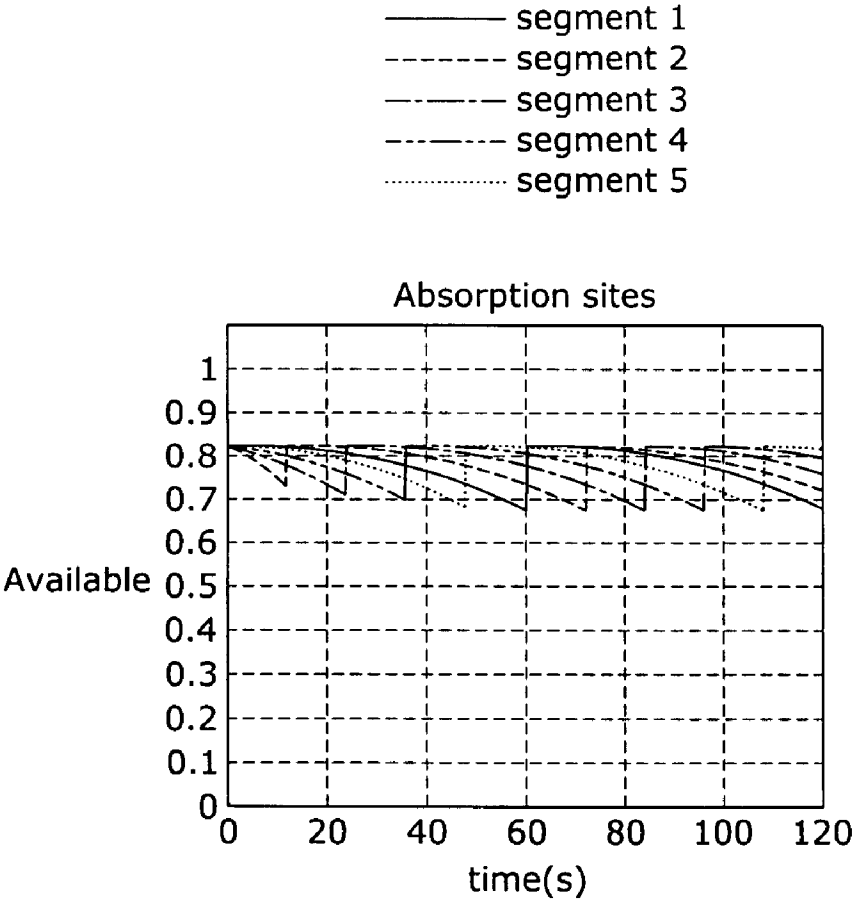

FIGS. 21*a* and 21*b* are graphs showing the impact of the reduced NOx input (0.8) along with a reduced amount of precious metal in the catalyst segments. The time axis is at 120 seconds. FIG. 21*a* shows the number of adsorption sites available for each of segments 1-5 versus time. FIG. 21*b* shows the relative amount of NOx particles coming out of each of the segment stages relative to an input of NOx over time.

Figure 22B:
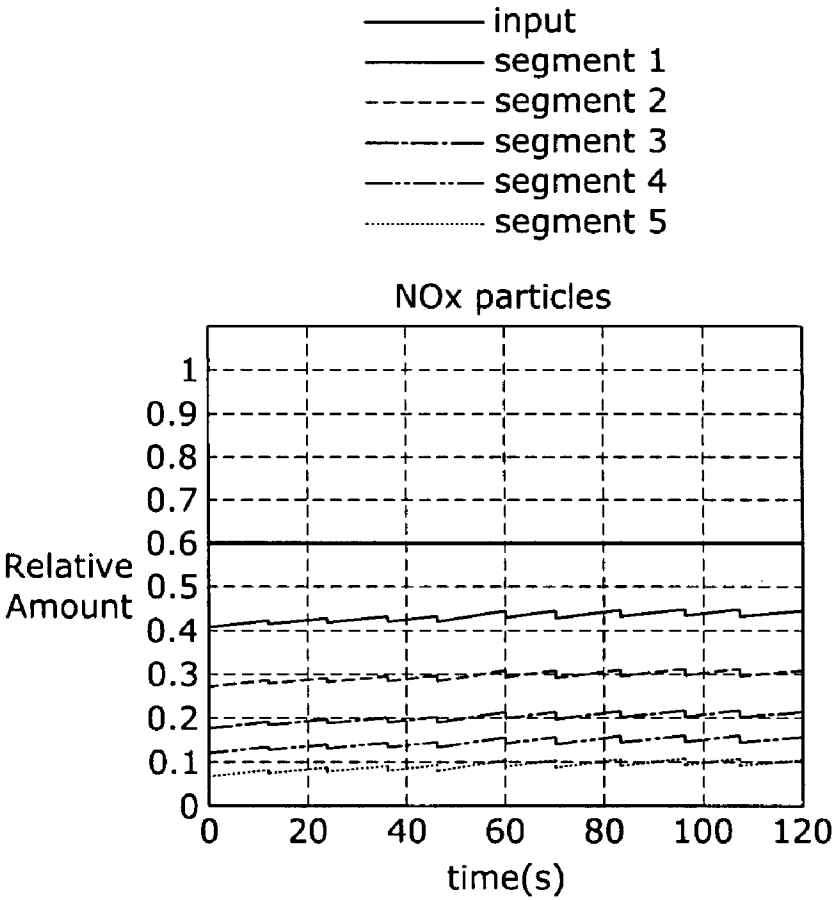
Figure 22A:
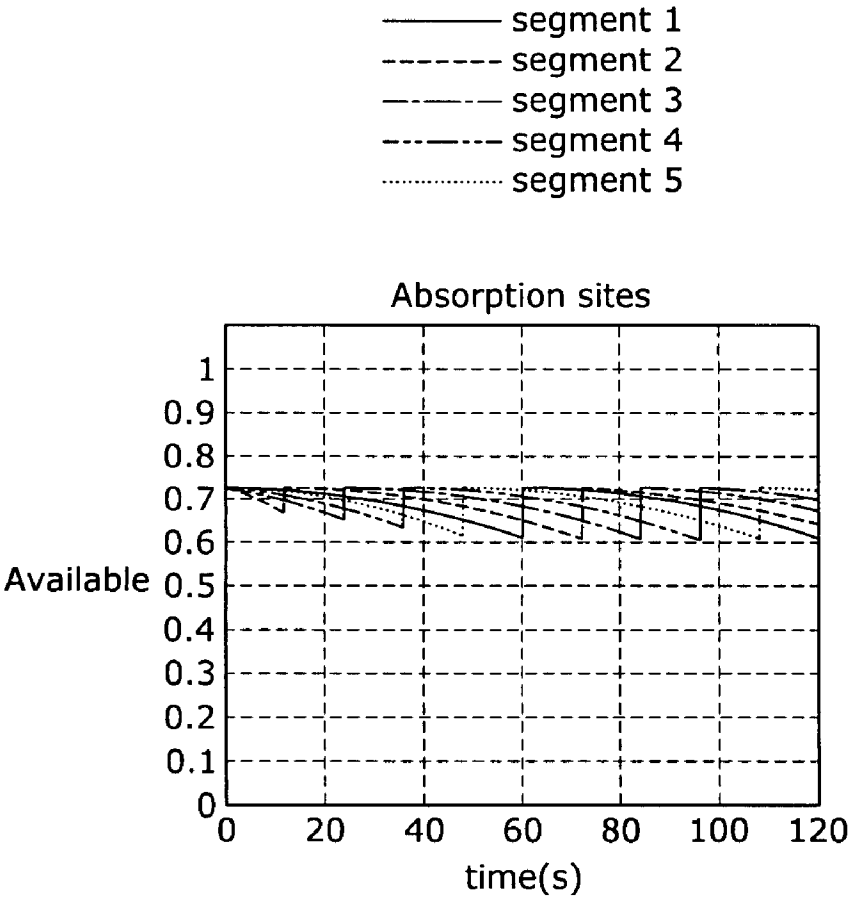

FIGS. 22*a* and 22*b* are graphs showing the impact of a further reduced NOx input of 0.6 along with also a reduced amount of catalyst. FIG. 22*a* shows the amount of adsorption sites available for each of segments 1-5 versus time. FIG. 22*b* shows the relative amount of NOx particles coming out of each of the segment stages relative to an input of particles over time.

An NOx removal model may be established. $c_i$ may be the concentration of NOx (normalized to 1=maximum input); $n_i$ may be the number of adsorption sites (normalized to 1=fresh after regeneration); the catalyst may be divided into 5+1 elements/10 slices in each element; the residence time in each slice dx may be dt; diffusion and desorption may be neglected; the regeneration time may be 5 seconds; and a simple 1st order model may be used. The formulae may include:

$$n_i(t+dt)=n_i(t)-k_n n_i(t)c_i(t)dt; \text{ and}$$

$$c_{i+1}(t=dt)=c_i(t)-k_c n_i(t)c_i(t)dt.$$

There may be an impact of geometry of the catalyst model. For a geometry 1 or first geometry, the "thick" aspect ratio, $k_n$, $k_c$ may be calibrated given an initial output (NOx=0.01) for a fully regenerated catalyst, and an average output NOx to trigger a regeneration (NOx=0.1) after a 60 second period. For a geometry 2 or second geometry, the "thin" aspect ratio, $k_n$, $k_c$ may be calibrated given an initial output (NOx=0.001) for a fully regenerated catalyst, and an average output (NOx_avg=0.1) to trigger a regeneration after a 60 second period. The geometry 1 versus geometry 2 may be a different ratio between $k_n$, $k_c$, relative to depletion of the catalyst per unit NOx removed.

Figure 23:
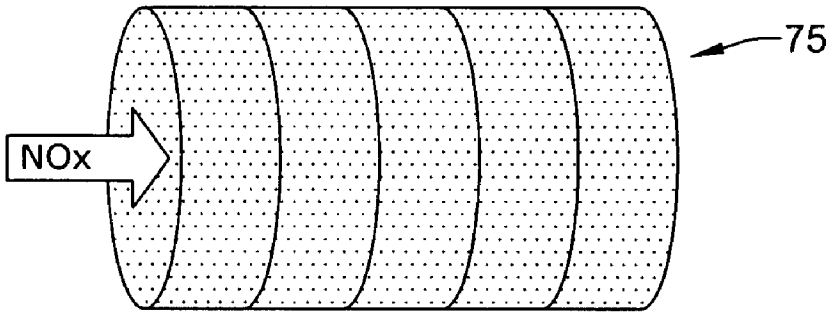
FIGS. 23, 24 and 25 illustrate the geometry of various catalyst batch-type operations.
Figure 25:
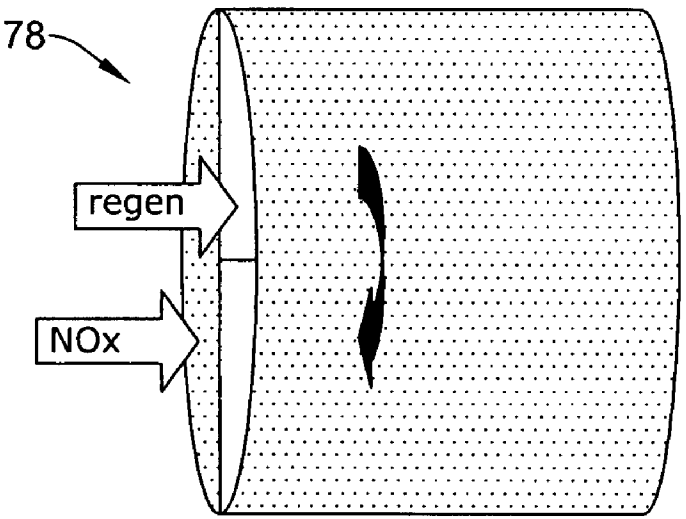
Figure 24:
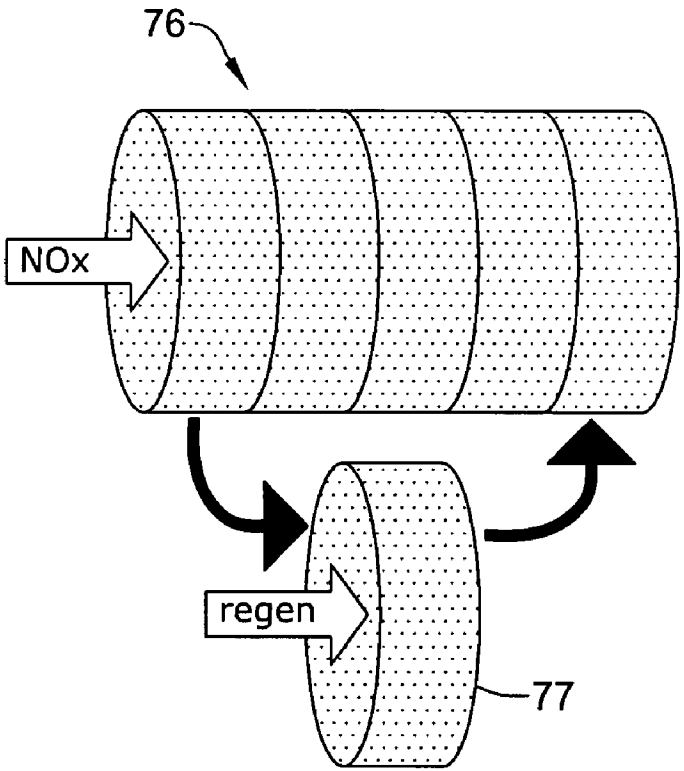

One may note the reference and rotatory geometries illustrated in FIGS. 23, 24 and 25. FIG. 23 shows a single element catalyst 75 batch operation (a basis for comparison), where all of the segments are operated for time $\Delta t_1$=60 s and all segments are regenerated for $\Delta t_2$=5 s. FIG. 24 shows a multi-element catalyst 76 batch operation (geometry 1, 2), where n+1 segments are used and n=5, n segments are operated for time Δt=6 s, the 1st segment is regenerated for the same time, a fresh segment 77 is swapped to the end of the catalyst pack 76, and there is a correspondence to rotating design with a triggered rotation.

FIG. 25 shows a multi-element catalyst 78 semi batch operation (geometry 2), where two axial segments are used, the 01st segment is operated for time Δt=6 s, the 2nd element is regenerated for the same time, and a fresh segment is swapped to the NOx stream. A triggered or continuous operation is possible.

Figure 26B:
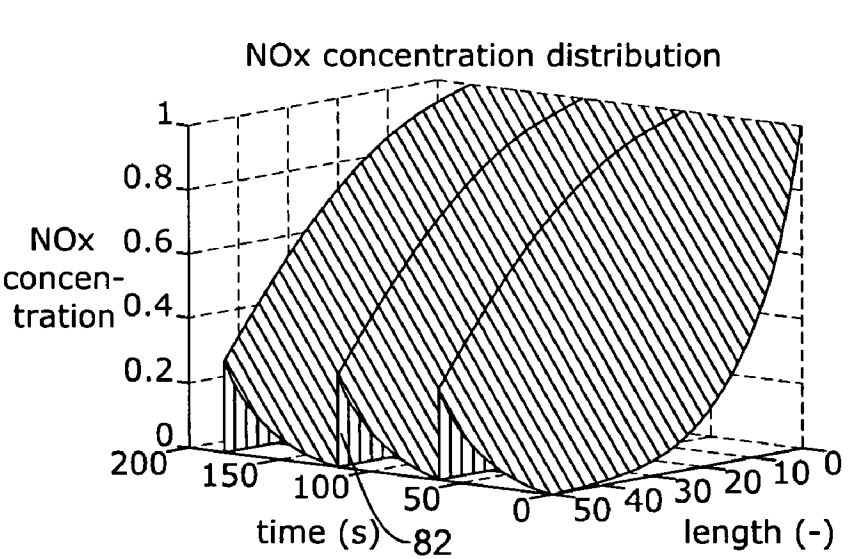
FIGS. 26*a* and 26*b* are graphs illustrating NOx concentration for a first geometry of catalyst operation.
Figure 26A:
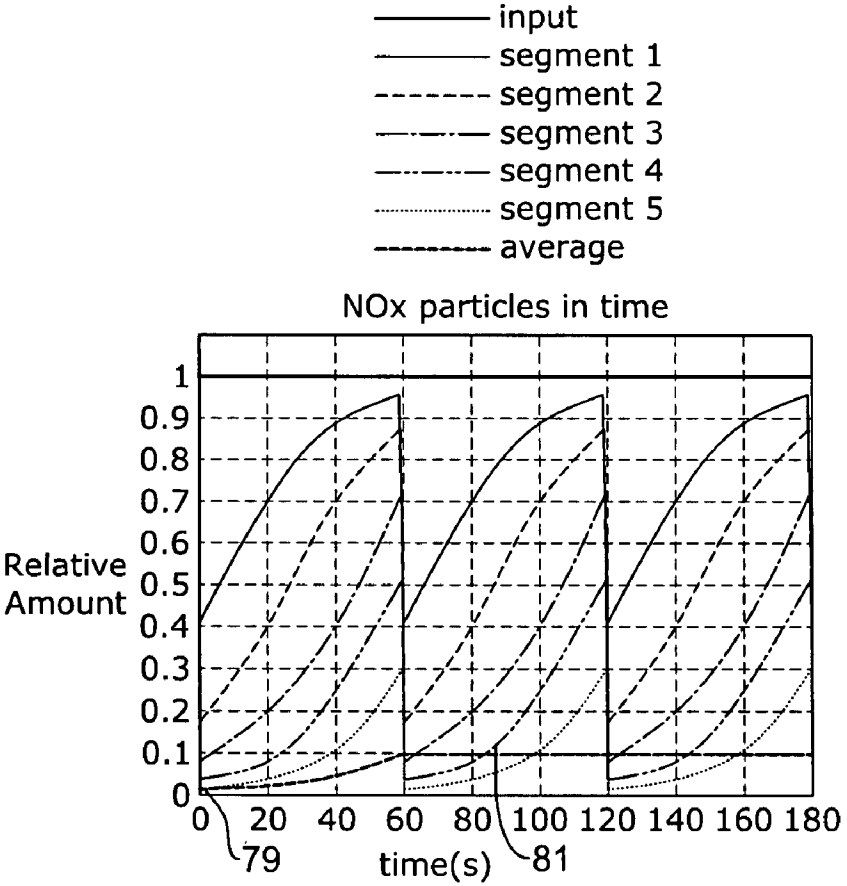

FIGS. 26*a* and 26*b* are graphs revealing the NOx concentration for the first geometry of the catalyst. FIG. 26*a* shows the relative amount of NOx in time for the multi-segment system. The initial NOx out is 0.01 at point 79. At t=60 seconds at point 81, the average NOx out=0.1. FIG. 26*b* is a three-dimensional graph showing NOx concentration versus time and length. At point 82 is an NOx profile in space/time with an average NOx output=0.1.

Figure 27B:
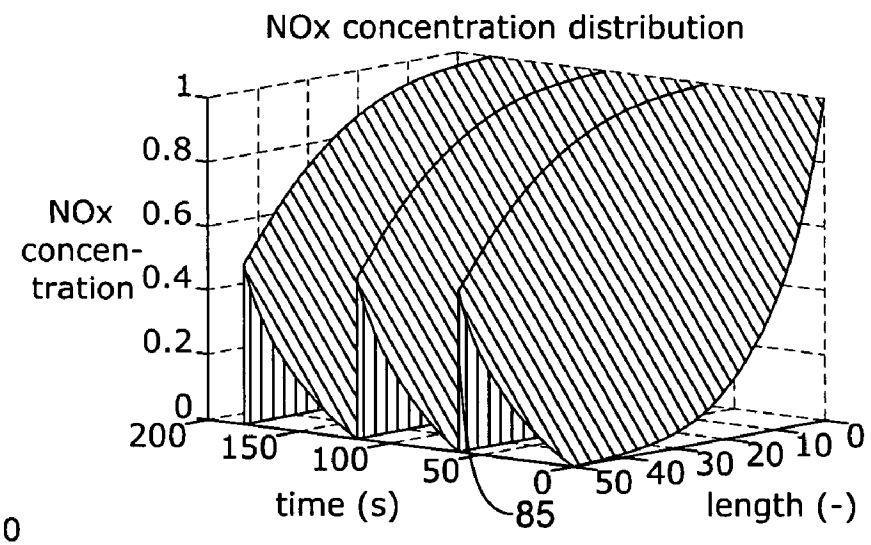
FIGS. 27*a* and 27*b* are graphs illustrating NOx concentration for a second geometry of catalyst operation.
Figure 27A:
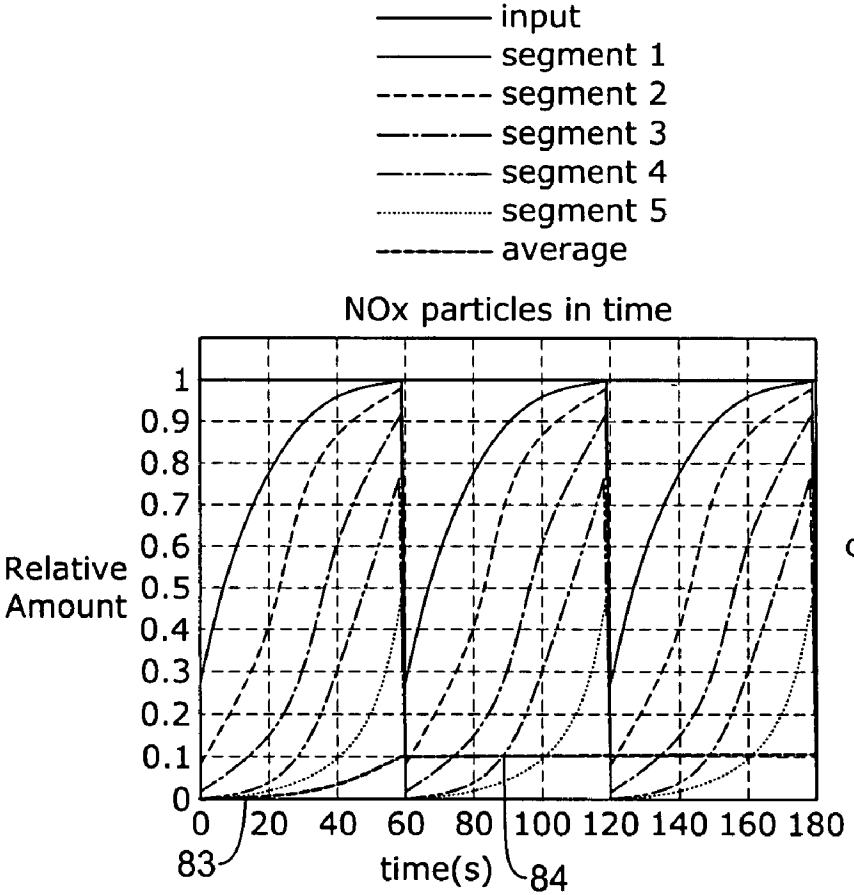

FIGS. 27*a* and 27*b* are graphs like those of FIGS. 26*a* and 26*b* illustrating NOx concentration for a second geometry of catalyst operation. One may note that at point 83 the initial NOx out=0.001. At point 84 for t=60 seconds, the average NOx out=0.1. FIG. 27*b* is a three-dimensional graph showing NOx concentration versus time and length. At point 85 is an NOx profile in space/time with an average NOx output=0.1.

Figure 28:
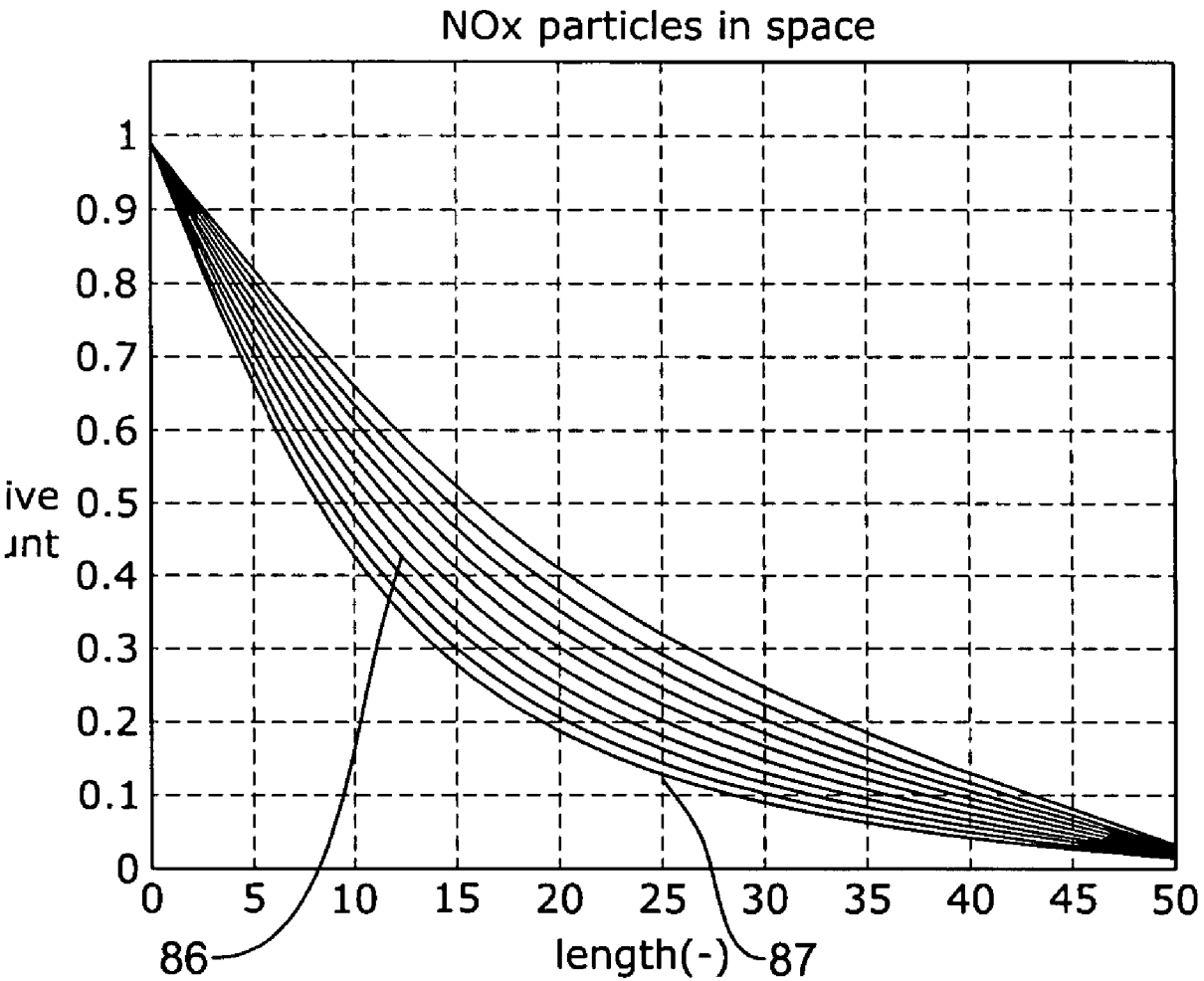
FIG. 28 is a graph showing NOx profiles for a multi-element catalyst system.

FIG. 28 is a graph showing NOx profiles where dt=2 seconds, such as at point 86. The graph shows the relative amount of NOx particles versus length in space. Point 87 shows a first element output for n=2 where NOx_out>0.1 at t=2.

Figure 29B:
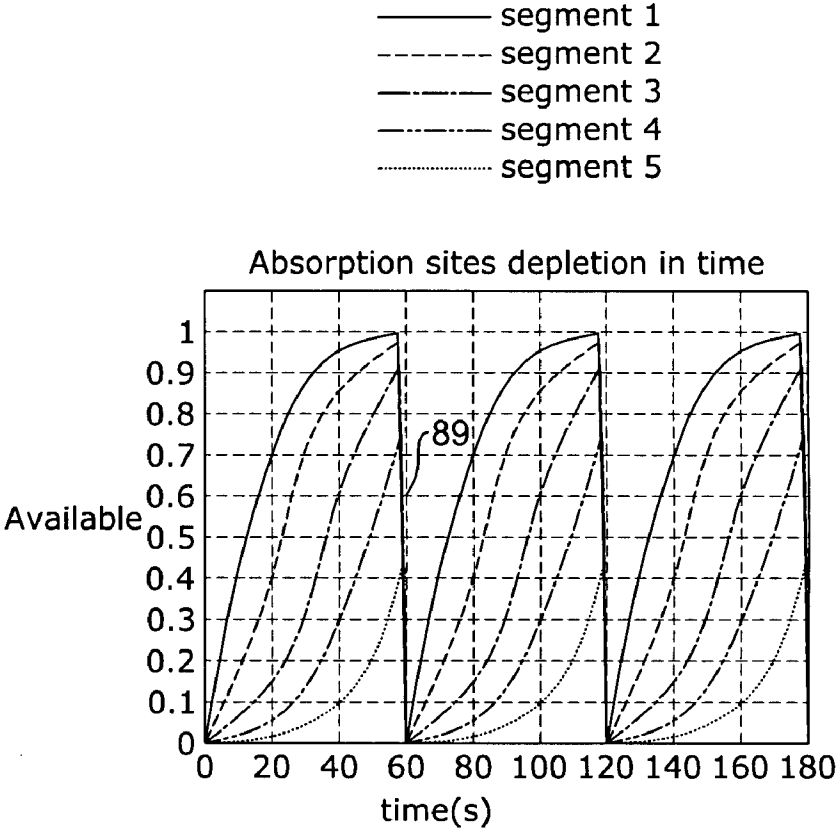
FIGS. 29*a* and 29*b* are graphs showing a comparison of absorption sites depletion in time for the first and second geometries of the catalyst system.
Figure 29A:
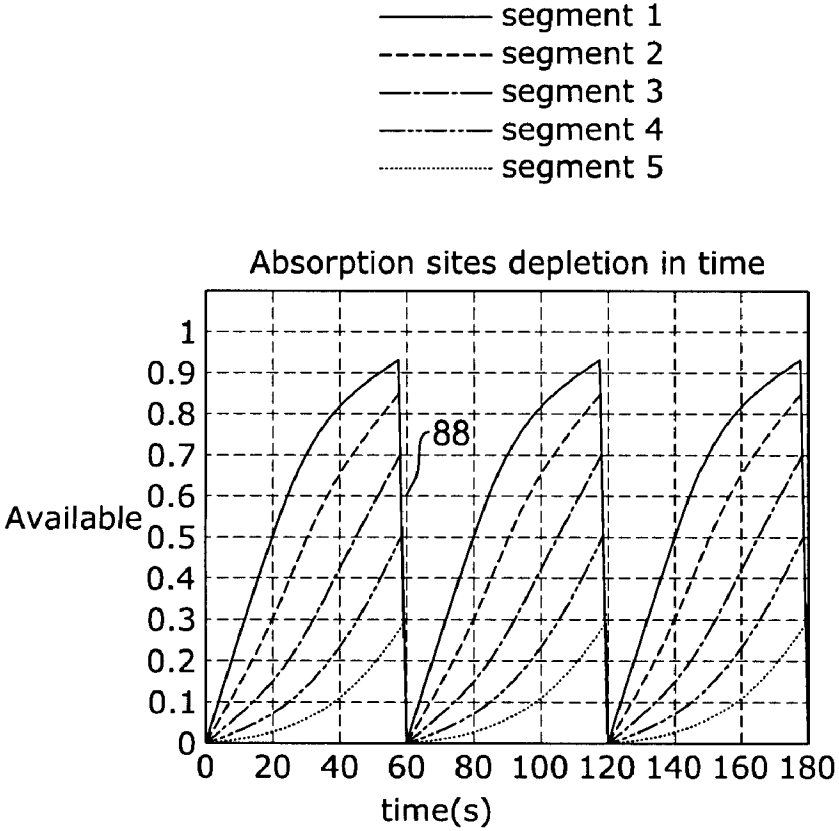

FIGS. 29*a* and 29*b* are graphs showing a comparison of absorption sites depletion in time for the first and second geometries, respectively, of the catalyst system. At point 88 for t=60 seconds, the first geometry appears to have a slower depletion. At point 89 for t=60 seconds, the second geometry appears to have a faster depletion. The relative depletion rate may be expressed as $k_{n1}/k_{c1}<k_{n2}/k_{c2}$.

Figure 30A:
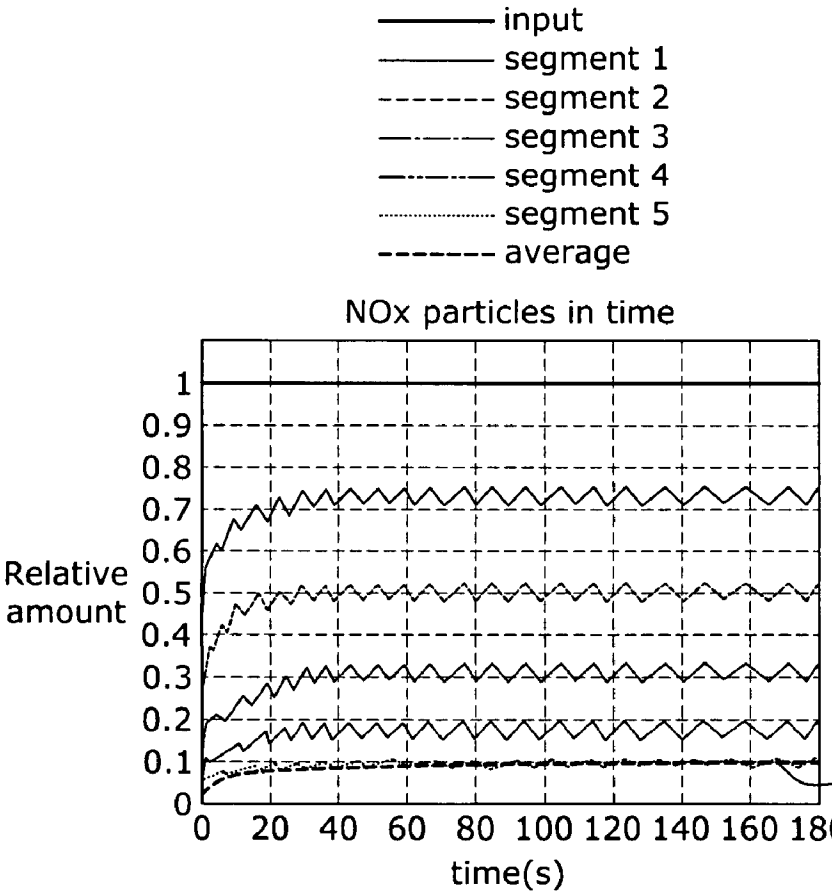
FIGS. 30*a* and 31*a* reveal relative amounts of NOx versus time for a catalyst system with precious metal reduction for the first and second geometries of the system, respectively.
Figure 31A:
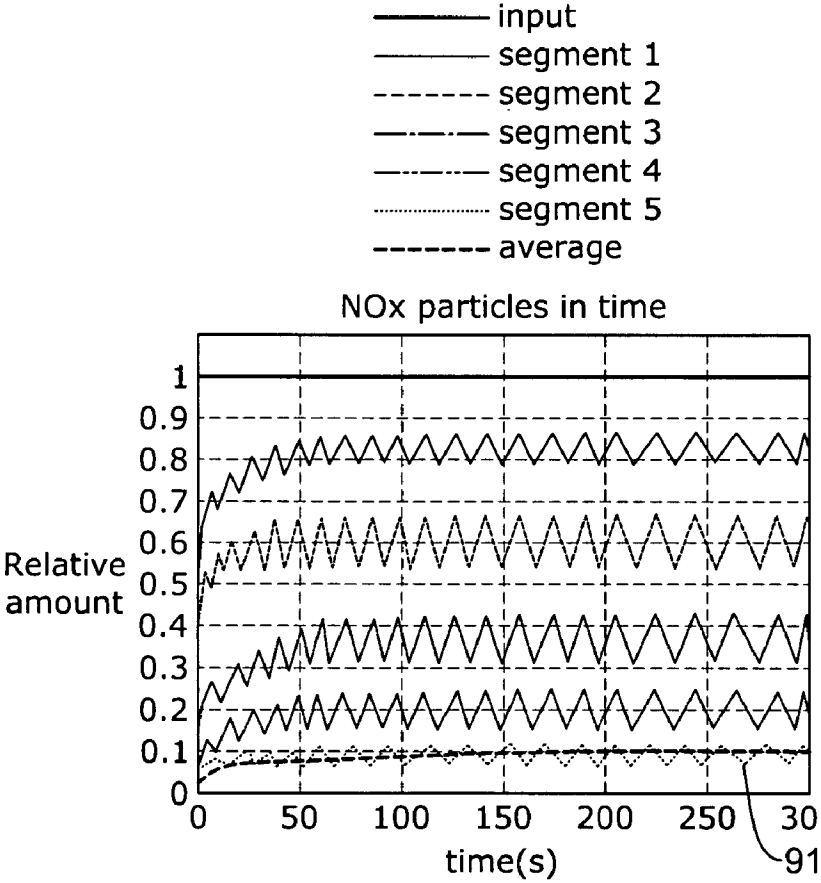

FIGS. 30*a* and 31*a* reveal relative amounts of NOx versus time for a catalyst system with a catalyst reduction for the first and second geometries of the system, respectively. The regeneration period is 6 seconds. Point 91 in FIGS. 30*a* and 31*a* appear to show a required average performance of NOx<0.1.

Figure 30B:
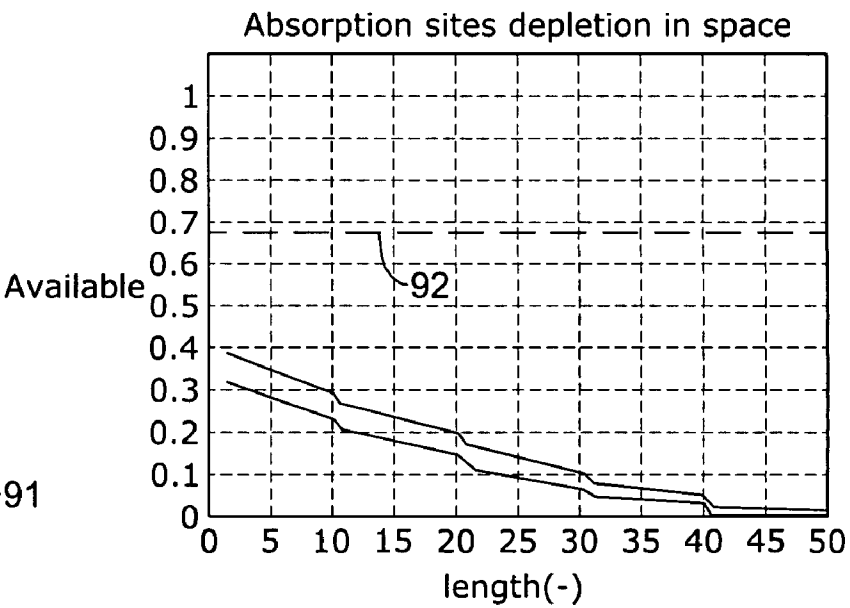
FIGS. 30*b* and 31*b* show adsorption sites depletion in space for a catalyst system with a catalyst reduction for the first and second geometries, respectively.
Figure 31B:
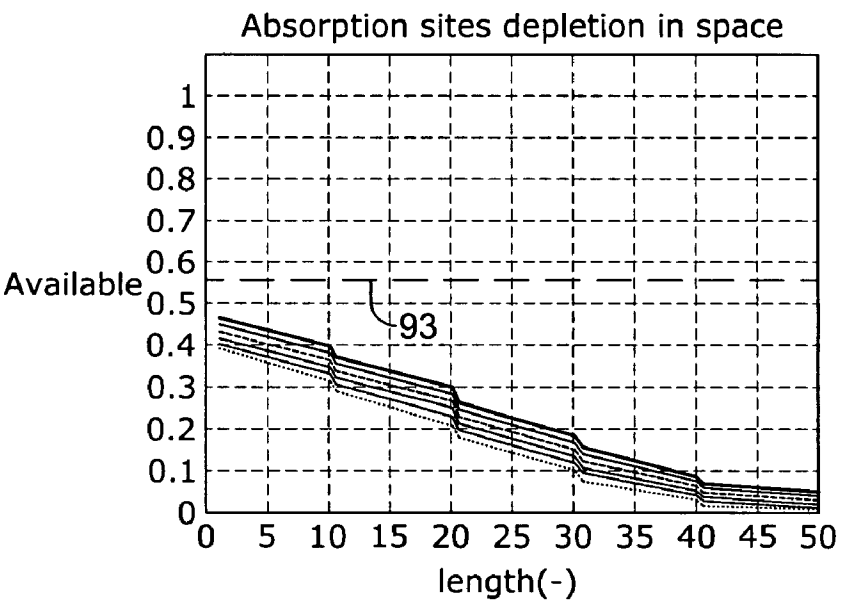

FIGS. 30*b* and 31*b* show adsorption sites depletion in space for a catalyst system with a catalyst reduction for the first and second geometries, respectively. Point 92 in FIG. 30*b* appears to show a catalyst reduction of 0.67*6/5=0.8. Point 93 of FIG. 31*b* appears to show a catalyst reduction of 0.56*6/5=0.67. The direct reduction from the respective graphs may be multiplied by the total number of segments of the system divided by the number of segments cleaning the exhaust.

Figure 32B:
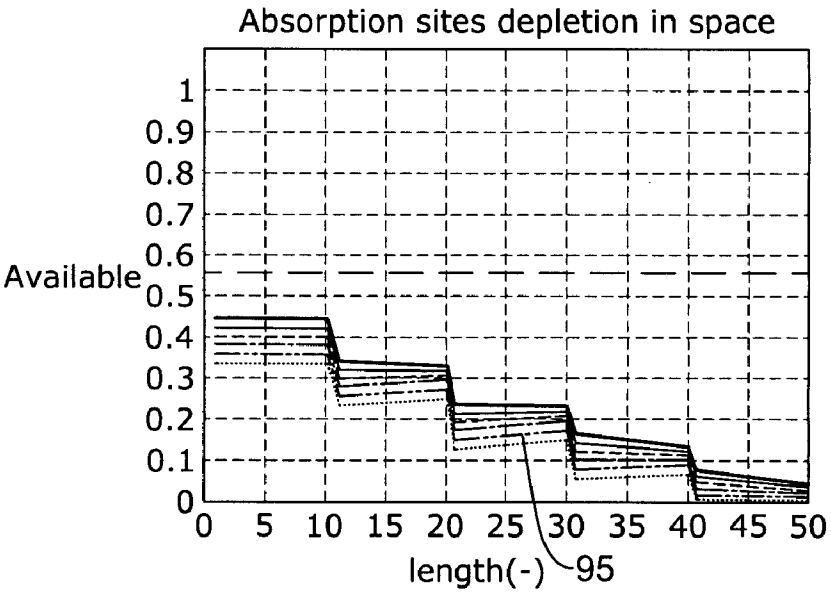
FIGS. 32*a* and 32*b* are graphs showing absorption sites depletion in space for a multi-segment catalyst system without and with flow direction switching, respectively.
Figure 32A:
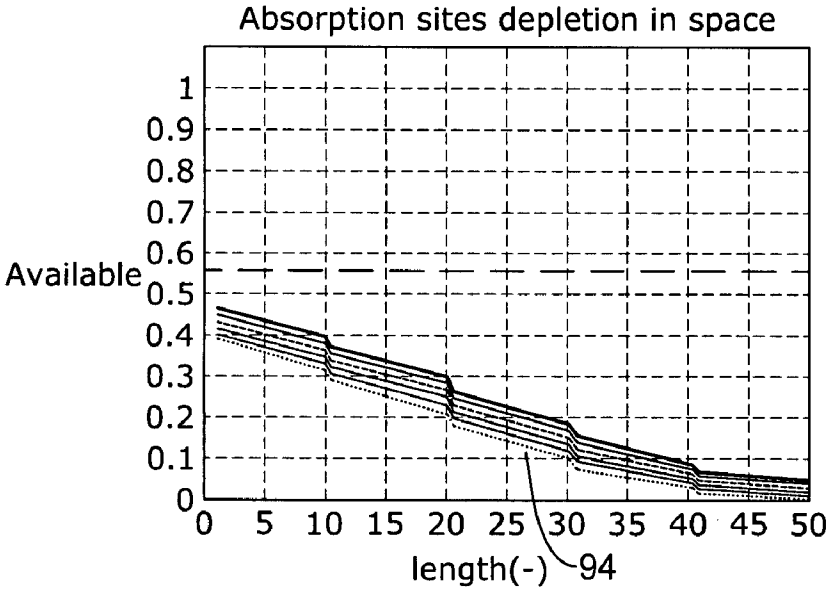

FIGS. 32*a* and 32*b* are graphs showing absorption sites depletion in space for a multi-segment catalyst system with without and with flow direction switching, respectively. The spatial profiles 94 may be at one second without flow direction switching. The spatial profiles 95 may be at one second with flow direction switching. The regeneration may be at 6 seconds. There appears to be a more uniform depletion in the segments. The impact on catalyst reduction appears to be minimal.

Figure 33A:
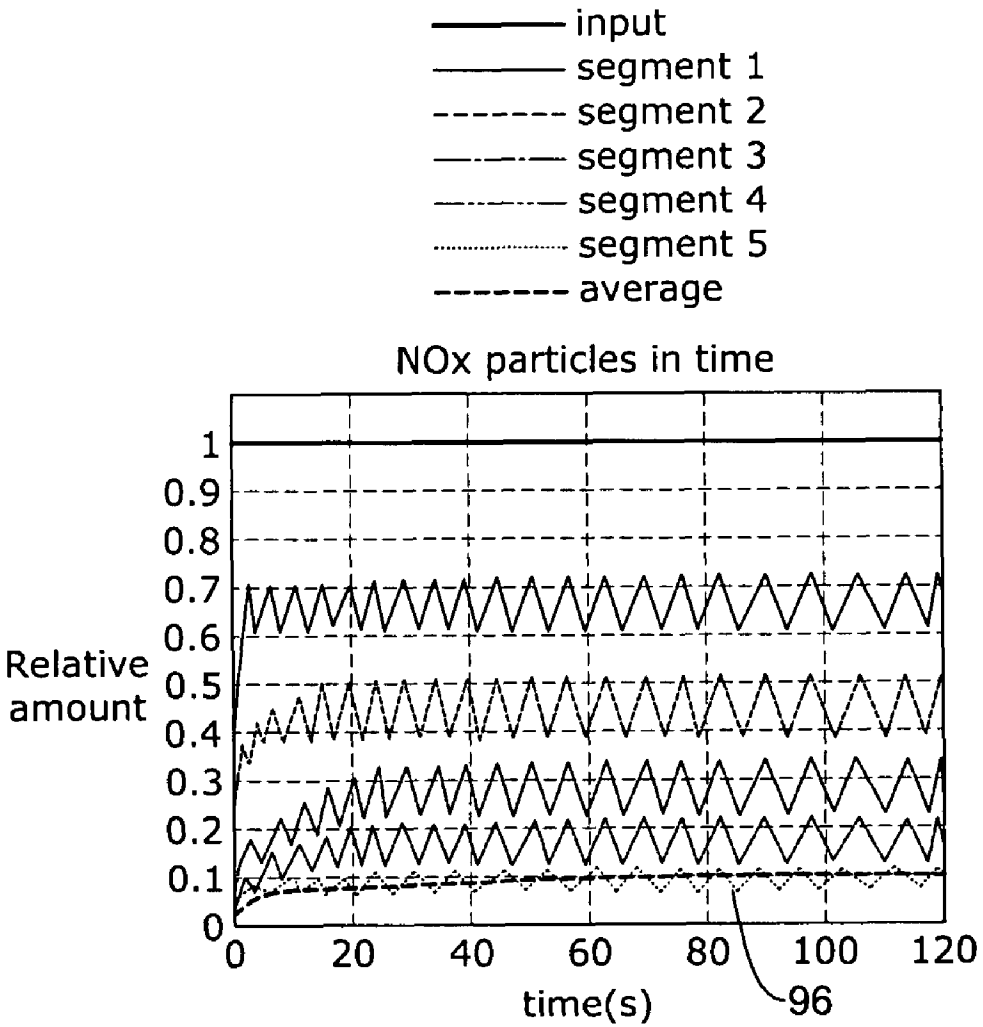
FIGS. 33*a*, 33*b* and 33*c* are graphs showing the relative amount of NOx in time, the relative amount NOx in space, and absorption sites depletion in space for the second geometry of the catalyst system.
Figure 33C:
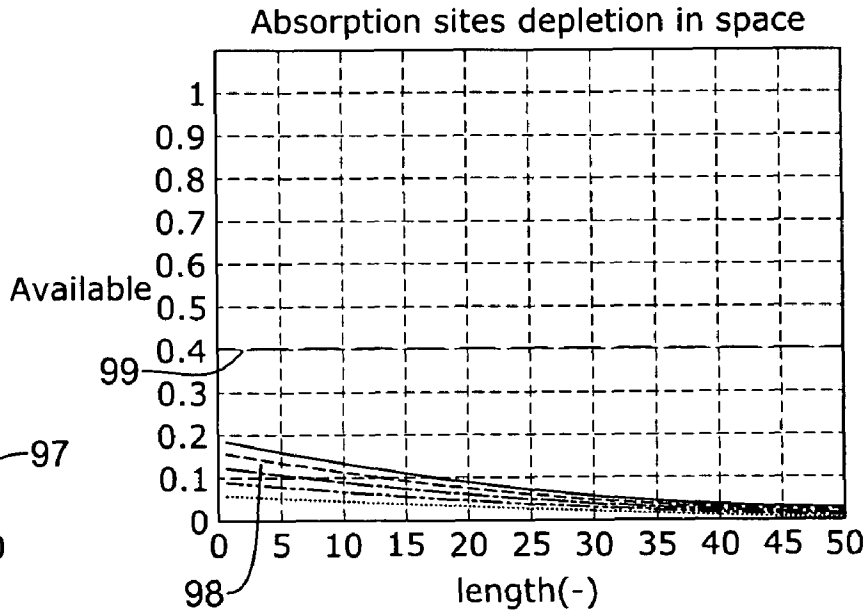
Figure 33B:
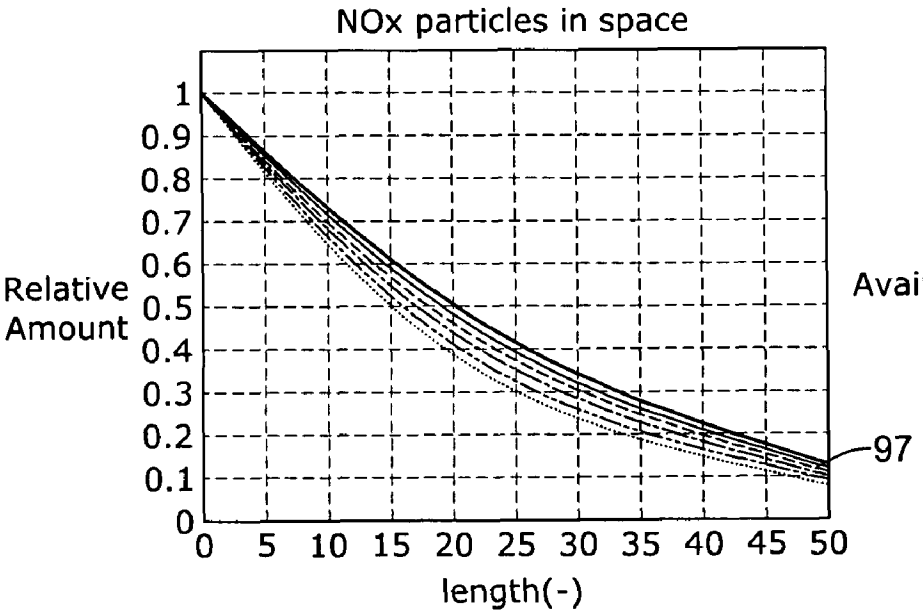
Figure 34B:
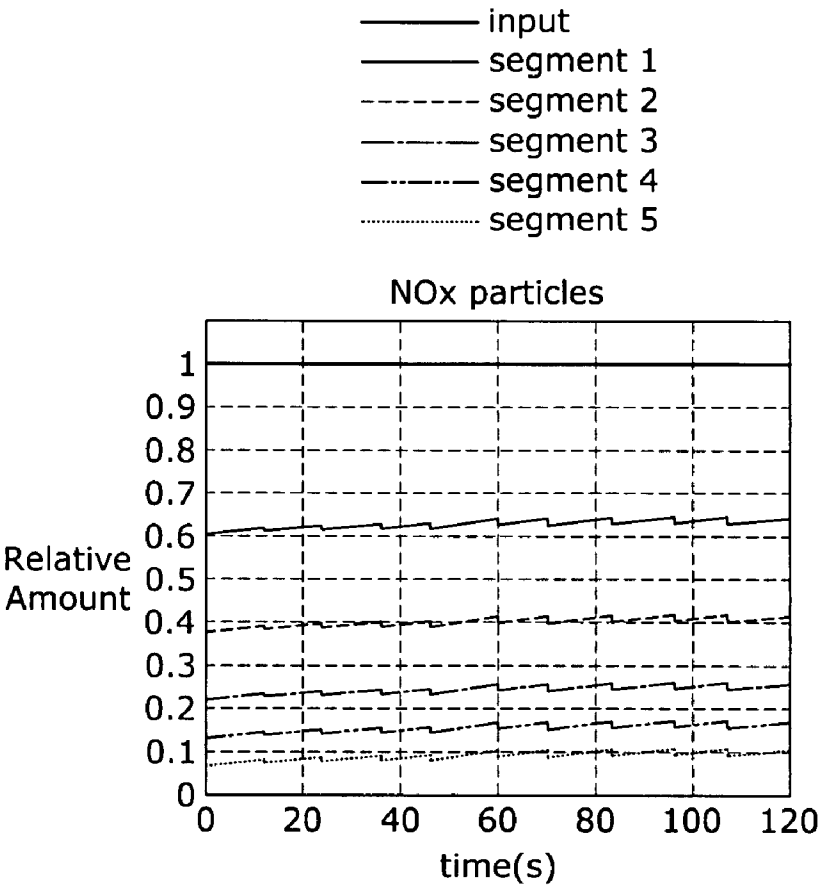
FIGS. 34*a*, 34*b*, 35*a*, 35*b*, 36*a* and 36*b* are graphs showing an impact of the segment regeneration order for regenerating the segment attached last, attached first and sequentially in view of available adsorption sites in time and the relative amount of NOx, respectively, with regard to an achievable catalyst reduction for a multi-segment catalyst system.
Figure 34A:
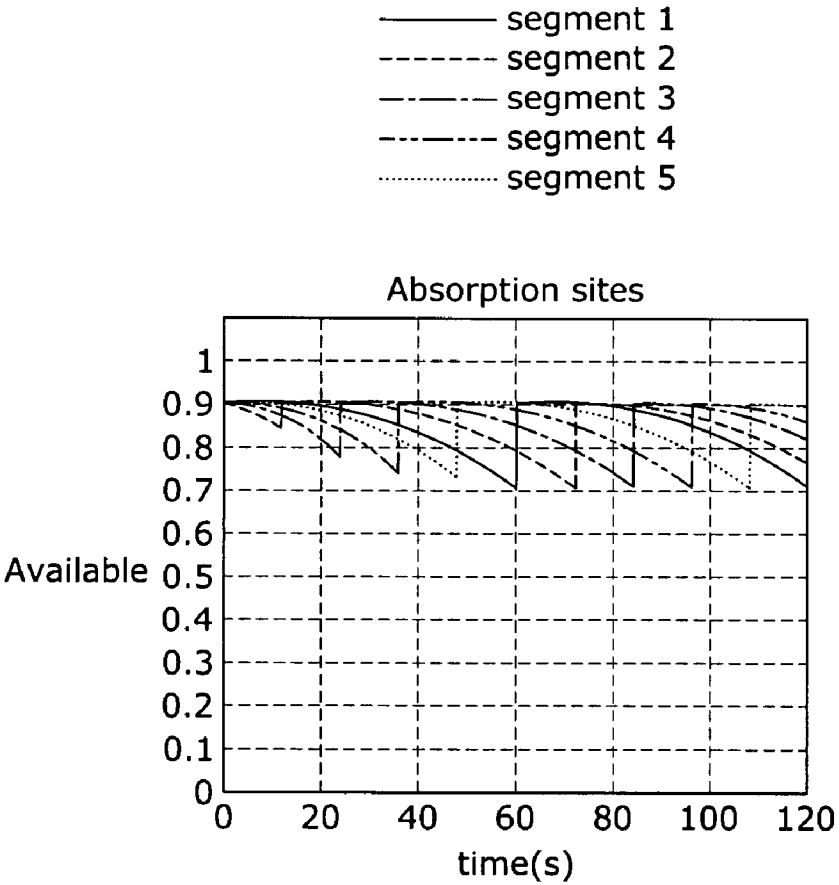
Figure 35B:
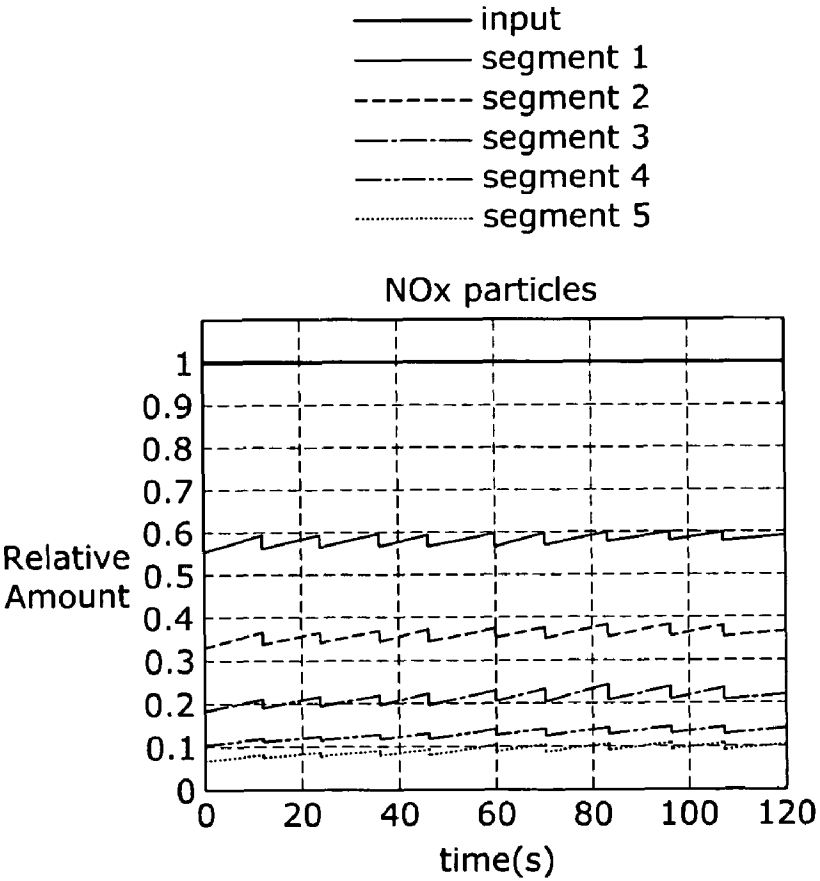
Figure 35A:
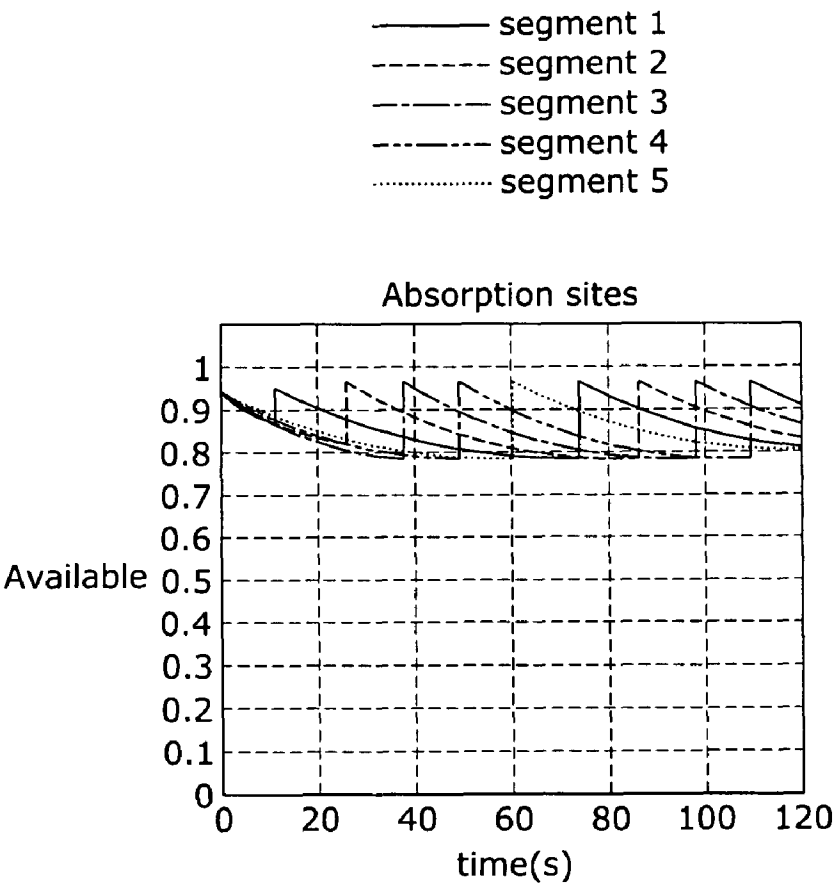
Figure 36B:
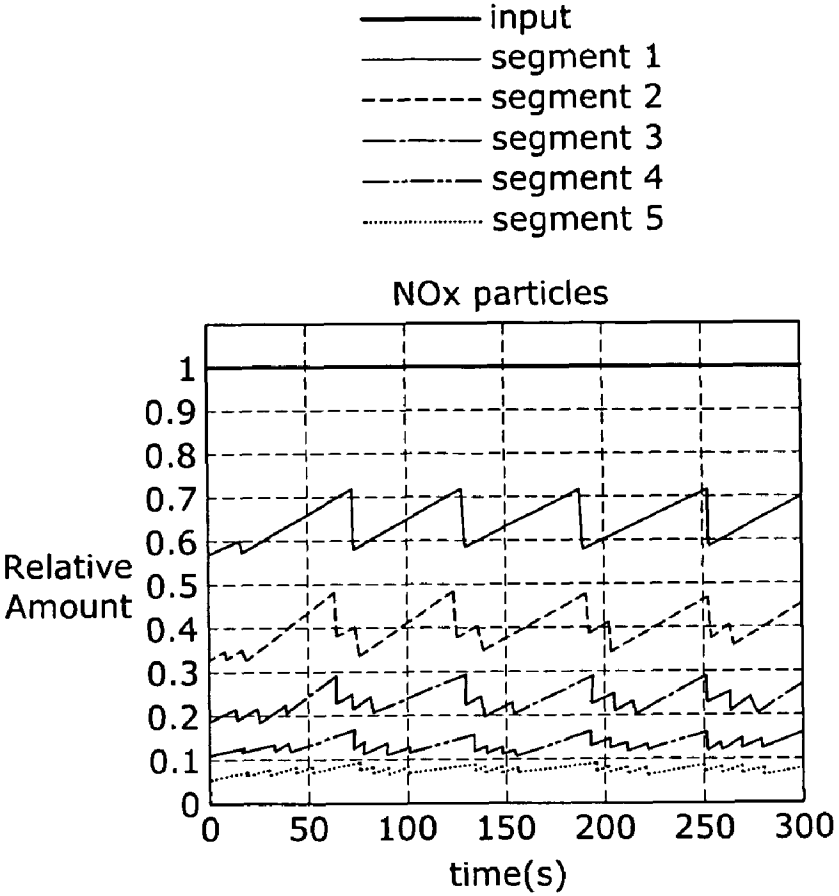
Figure 36A:
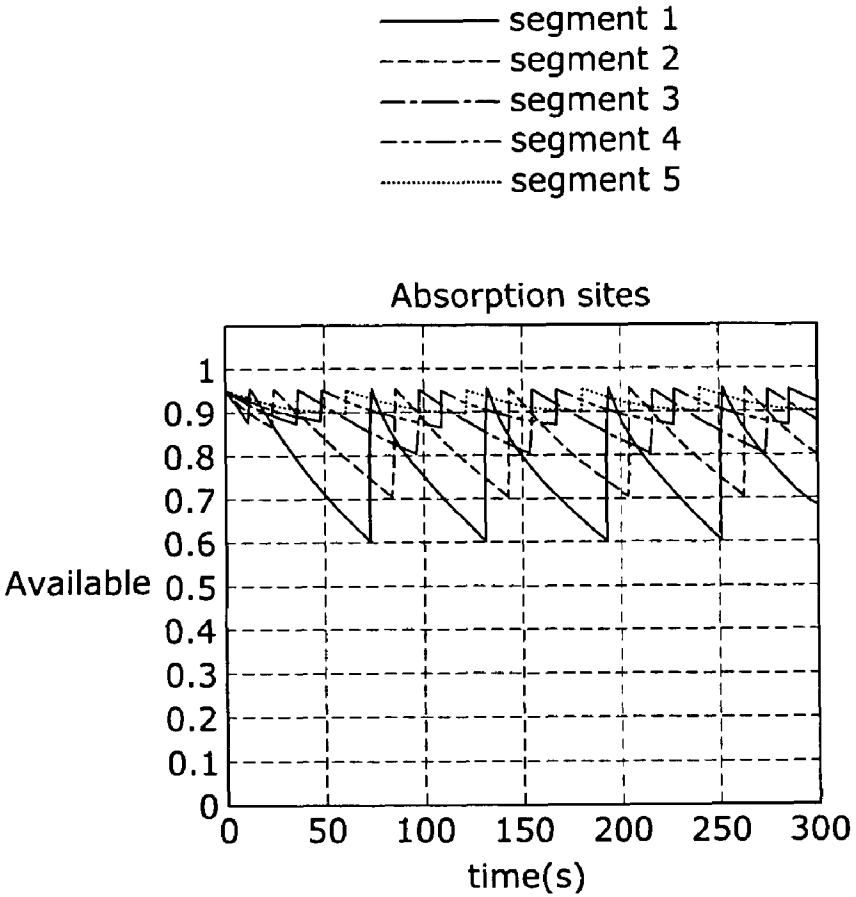

FIGS. 33*a*, 33*b* and 33*c* are graphs showing the relative amount of NOx in time, the relative amount NOx in space and absorption sites depletion in space for the second geometry of a system with a catalyst load of 40 percent. Point 96 of the graph in FIG. 33*a* shows a required average performance of NOx<0.1. Point 97 in the graph of FIG. 33*b* shows an output NOx sampled at one second. Point 98 show a catalyst depletion sampled at one second in the graph of FIG. 33*c*. The catalyst reduction may be noted at point 99 of the graph of FIG. 33*c*. The catalyst reduction achieved may be calculated as 0.4*2=0.8 for the second geometry.

FIGS. 34*a*, 34*b*, 35*a*, 35*b*, 36*a* and 36*b* are graphs showing an impact of the segment regeneration order optimization for regenerating the segment attached last, attached first and sequentially in view of available adsorption sites in time and the relative amount of NOx particles, respectively, with regard to an achievable catalyst reduction for a multi-segment catalyst system. The system may be a six-segment catalyst having one of the segments being regenerated at a time while the remaining five segments are active. The saturation time of the segments may be 60 seconds while the regeneration time may be 12 seconds. Where the regeneration segment is attached last, the achievable catlayst reduction may be 0.9. Where the regeneration segment is attached first, the achievable catalyst reduction may be 0.96. In the case where the regeneration of the segments is done sequentially, the achievable catalyst reduction may be 0.96.

Although the invention has been described with respect to at least one illustrative embodiment, many variations and modifications will become apparent to those skilled in the art upon reading the present specification. It is therefore the intention that the appended claims be interpreted as broadly as possible in view of the prior art to include all such variations and modifications.

What is claimed is:

1. A catalyst device comprising:

a plurality of sections having a material for adsorbing and catalyst for appropriate chemical treatment of NOx, the plurality of sections for connection to an exhaust of an engine;

a source of regeneration fluid; and a plurality of valves positioned between the sections, the valves regulating flow of exhaust through the sections and regulating flow of regeneration fluid through the sections, wherein the valves are configured to allow flow in only one direction through each section;

wherein each section, one at a time, is in a regeneration stage to reduce adsorbed NOx.

2. The device of claim 1, wherein the sections of the plurality of sections, except the section in the regeneration stage, are connected in series.

3. The device of claim 1, wherein the plurality of sections, except the section in the regeneration stage, is interconnected in parallel.

4. The device of claim 1, wherein the section in the regeneration stage is connected to a flow which heats up the section sufficiently to reduce adsorbed NOx.

5. The device of claim 4, wherein:

each section of the plurality of sections is disconnected from the exhaust and connected to the flow which heats up the section; and the section in the regeneration stage is reconnected to the exhaust.

6. The device of claim 3, wherein the section in the regeneration stage is connected to a flow which heats up the section sufficiently to reduce accumulated SOx in the section.

7. The device of claim 6, further comprising a filter.

8. The device of claim 7, wherein the filter is connected to at least one of the plurality sections.

9. The device of claim 8, wherein the filter, at certain times, is connected to a flow that is sufficient to regenerate the filter.

10. The device of claim 9, wherein to regenerate the filter is to oxidize particulate matter in the filter.

11. A catalyst system comprising:

at least two chambers having a catalyst material, the chambers connected to an exhaust of an engine; and wherein the at least two chambers are separately connectable one at a time to a regenerating fluid, wherein regeneration flow through the chambers is independent of exhaust flow through the chambers, wherein regeneration fluid flows through the chambers in the same direction as exhaust flow.

12. The system of claim 11, wherein the regenerating fluid is for reducing the amount of adsorbed NOx in a chamber.

13. The system of claim 11, wherein the regenerating fluid is for reducing an amount of adsorbed SOx in a chamber.

14. The system of claim 11, further comprising a filter connected to at least one chamber of the at least two chambers.

15. The system of claim 14, wherein the regenerating fluid is for reducing an amount of particulate matter in the filter.

16. The system of claim 12, wherein the at least two chambers minus one are connected to an exhaust of an engine.

17. A catalytic converter comprising:

a housing having a plurality of chambers; and wherein:

at least two chambers of the plurality of chambers are for processing an engine exhaust fluid;

at least one chamber of the plurality of chambers is temporarily for being regenerated; and a plurality of valves positioned between the chambers, the valves configured to divert fluid flow from the chamber being regenerated such that it bypasses the chambers for processing exhaust fluid, wherein the valves are configured to direct a regeneration fluid through the chamber being regenerated in the same direction as the exhaust fluid flows through the chambers processing the exhaust fluid.

18. The converter of claim 17, wherein the at least one chamber temporarily for being regenerated is subject to being occasionally replaced by another at least one chamber temporarily for being regenerated.

19. The converter of claim 17, wherein:

the processing is removing at least some of the NOx and/or SOx from the exhaust gas; and the being regenerated is an elimination of at least some of the NOx and/or SOx in the at least one chamber.

20. The converter of claim 19, wherein the at least two chambers are connected in series.

21. The converter of claim 19, further comprising a particulate matter filter connected to the at least one chamber for processing the fluid.

22. The converter of claim 21, wherein the filter is occasionally regenerated to reduce an amount of particulate matter in the filter.

23. The converter of claim 22, wherein the at least two chambers are connected in parallel.

24. A method for attaining a regenerative catalyst system, comprising:

providing a multi-unit catalyst system;

connecting the system to an exhaust system so that at least one unit is not connected to the exhaust system;

connecting the at least one unit to a source of gas to regenerate the at least one unit without reversing flow direction; and upon a partial or more regeneration of the at least one unit, exchanging the at least one unit with another at least one unit of the multi-unit catalyst system, for a partial or more regeneration of the another at least one unit.

25. The method of claim 24, further comprising:

a plurality of valves situated between the units; and operating the valves to exchange the at least one unit with another unit of the multi-unit system for a partial or more regeneration of the another at least one unit.

26. The method of claim 25, further comprising:

attaching actuators to the valves;

connecting the actuators to a processor; and programming the processor to operate the valves to achieve the method of the preceding claims.

27. The method of claim 26, further comprising:

connecting a filter to the multi-unit catalyst system; and regenerating the filter as needed.

28. Means for regenerating a catalyst, comprising:

means for removing pollutants from an exhaust of an engine; and means for regenerating; and wherein:

the means for removing pollutants is partitioned into a plurality of segments;

at least one segment of the plurality of segments is connected to the means for regenerating; and the at least one segment is exchanged occasionally with another at least one segment from the plurality of segments; wherein flow through the regenerating segment is independent of and in the same direction as flow through remaining segments.

29. The means of claim 28, wherein the at least one segment is replaced with another at least one segment from the plurality of segments when the at least one segment is at least partially regenerated.

30. The means of claim 29, further comprising a means for filtering particulate matter from the exhaust of an engine.

31. The means of claim 29, further comprising:

means for exchanging segments;

sensors situated in the plurality of segments; and a processor connected to the sensors and the means for exchanging segments.

32. A regeneration system comprising:

a unit having at least two catalyst segments;

a mechanism for selecting out a segment from the unit for regeneration;

sensors in the segments;

a plurality of valves situated between the segments, the valves configured to divert flow for regeneration without reversing flow direction; and a controller connected to the sensors and to the mechanism for selecting out a segment.

33. The system of claim 32, further comprising a filter connected to the unit having at least two catalyst segments.

* * * * *